US005582230A

United States Patent [19]

Wagstaff et al.

[11] Patent Number: 5,582,230

[45] Date of Patent: Dec. 10, 1996

[54] DIRECT COOLED METAL CASTING PROCESS AND APPARATUS

[75] Inventors: Robert B. Wagstaff, Veradale; David A. Salee, Spokane, both of Wash.

[73] Assignee: Wagstaff, Inc., Spokane, Wash.

[21] Appl. No.: 201,768

[22] Filed: Feb. 25, 1994

[51] Int. Cl.[6] ..... B22D 11/04; B22D 11/24

[52] U.S. Cl. ..... 164/483; 164/444; 164/487

[58] Field of Search ..... 164/487, 483, 164/486, 444

[56] References Cited

U.S. PATENT DOCUMENTS

| | | | |
|---|---|---|---|
| 3,713,479 | 1/1973 | Bryson . | |
| 4,166,495 | 9/1979 | Yu | 164/486 |
| 4,693,298 | 9/1987 | Wagstaff | 164/486 |
| 5,040,595 | 8/1991 | Wagstaff | 164/487 |
| 5,119,883 | 6/1992 | Wagstaff et al. | 164/487 |

FOREIGN PATENT DOCUMENTS

| | | |
|---|---|---|
| 0095151 | 11/1983 | European Pat. Off. . |
| 0533133 | 3/1993 | European Pat. Off. . |
| 1138627 | 6/1957 | France . |
| 1592458 | 6/1970 | France . |
| 813755 | 9/1951 | Germany . |
| 1433021 | 10/1968 | Germany . |
| 62-220248 | 9/1987 | Japan . |

OTHER PUBLICATIONS

S. J. Salyzak et al "Effects of Interactions Between Adjoining Rows of Circular, Free Surface Jets on Local Heat Transfer from the Impingement Surface", *Journal of Heat Transfer*, American Society of Mechanical Engineers, vol. 16, Feb. 1994, pp. 88–95.

*Primary Examiner*—J. Reed Batten, Jr.
*Attorney, Agent, or Firm*—Christopher Duffy

[57] ABSTRACT

In direct cooling an ingot emerging from a mold, two sets 136 and 142 of liquid coolant streams are discharged onto the ingot from an annulus 62 circumposed about the lower end opening 72 of the mold. One set of streams, 136, is discharged downwardly at 22.5 degrees to the axis 12 of the mold, and the other, 142, is discharged downwardly at 45 degrees to the axis of the mold. The two sets are staggered to one another circumferentially of the mold, and because of the high angle of incidence of the 45 degree set to the axis of the mold, substantial portions of the 45 degree streams rebound from the surface of the ingot at their points 144 of impact with the ingot, and mushroom into corolla-like masses of air borne liquid coolant spray 146 lying crosswise the paths of the 22.5 degree streams, which in turn entrain the spray and impact the successive layers 138 of coolant therebelow with the spray. To aid in the entrainment, the respective streams are spaced apart from one another so closely that the respective pairs of adjacent corolla-like masses of spray actually shoot up "interaction fountains" 148 of spray directly in the paths of the 22.5 degree streams of coolant. The effect is to widen the bands 135 of turbulence in the layers 138 of coolant; and the bands may even be widened to the extent of eliminating the laminar flow regime 137 in each layer. The height 133 of the bands is also commonly raised.

43 Claims, 12 Drawing Sheets

DIRECT COOLED METAL CASTING PROCESS AND APPARATUS

TECHNICAL FIELD

Our invention relates to a process and apparatus for casting molten metal into an elongated body of metal by the steps of pouring, that is, forcing molten metal under gravity through an open ended mold of a casting apparatus, while in two successive stages of a casting operation attendant to the pouring step, a bottom block which was initially cooperatively engaged with the lower end opening of the mold, that is, the discharge end opening of the mold, is lowered downwardly along a vertical axis of the mold, that is, an axis extending between the respective entry and discharge end openings of the mold, through a succession of successively lower levels in a pit there-below, that is, through a succession of planes which extend transverse the axis of the mold at successively greater increments of distance from the discharge end opening thereof in the direction relatively axially away from the entry end opening thereof, first to form an initial longitudinal section comprising the butt of the body of metal, as the bottom block is lowered through a relatively upper series of levels in the pit, and then in a successive steady state casting stage thereafter, to elongate the body of metal with additional longitudinal sections, as the bottom block is lowered through a relatively lower series of levels in the pit, the outer peripheral surface of the body of metal being exposed meanwhile to the ambient atmosphere of the pit, as the respective longitudinal sections in the body of metal are withdrawn from the mold through the relatively upper series of levels in the pit. More particularly, the invention relates to a means and technique for direct cooling the respective longitudinal sections in the body of metal as they are withdrawn from the mold through the relatively upper series of levels in the pit; and especially a means and technique of this nature whereby a differential is achieved between the cooling effect to which the initial longitudinal section is subjected, and the cooling effect to which each of the additional longitudinal sections is subjected, during the butt forming stage and the steady state casting stage of the casting operation, respectively.

BACKGROUND ART

In direct cooling the respective longitudinal sections in the body of metal during a conventional casting operation, liquid coolant is discharged into the ambient atmosphere of the pit below the lower end opening of the mold, and an initial longitudinal portion of a layer of liquid coolant is formed on the outer peripheral surface of the initial longitudinal section in the body of metal as the bottom block and the initial longitudinal section in the body of metal are withdrawn from the mold and lowered through the relatively upper series of levels in the pit. Then, while the bottom block and first, the initial longitudinal section in the body of metal, and then the successive additional longitudinal sections in the body of metal, are being lowered through the relatively lower series of levels in the pit during the steady state casting stage of the casting operation, an additional longitudinal portion of the layer of liquid coolant is formed on each successive additional longitudinal section in the body of metal, as the respective additional longitudinal sections in the body of metal are withdrawn from the mold through the relatively upper series of levels in the pit. Meanwhile, the liquid coolant in the initial longitudinal portion of the liquid coolant layer and in each successive additional longitudinal portion of the liquid coolant layer, flows by gravity downwardly along the surface of the body of metal through the relatively lower series of levels in the pit.

Numerous patents have been issued on the subject of direct cooling, and many of them show ways to control the process for some purpose related to varying the cooling effect of the respective longitudinal portions of the liquid coolant layer on the surface of the body of metal. See U.S. Pat Nos. 2,791,812, 3,441,079, 3,713,479, U.S. Pat. Nos. 3,623,536, 3,765,493, 4,166,495, 4,693,298, 5,040,595, 5,119,883 and U.S. Pat. No. 5,148,856 as examples. In some of the patents moreover, steps are taken to differentiate between the cooling effects to which the respective longitudinal sections in the body of metal are subjected during the butt forming stage and the steady state casting stage of the casting operation. In U.S. Pat. No. 3,441,079 to Bryson, for example, the liquid coolant is pulsed into the ambient atmosphere of the pit in a cyclical or on/off manner during the butt forming stage of the operation, to differentiate between the effects achieved during that stage and the steady state casting stage of the operation. In U.S. Pat. No. 4,351,384 to Goodrich, the initial longitudinal portion of the layer of liquid coolant is formed on the surface of the body of metal at a higher level in the relatively upper series of levels in the pit, for the butt forming stage of the operation, than are the additional longitudinal portions of the layer of liquid coolant formed thereafter for the steady state casting stage of the operation. In U.S. Pat. No. 4,166,495 to Yu, and U.S. Pat. No. 4,693,298, U.S. Pat. No. 5,040,595 and U.S. Pat. No. 5,119,883 to Wagstaff or Wagstaff et al, the mass flow rate of the liquid coolant is lowered during the butt forming stage, and then returned to a normal condition during the steady state casting stage, to differentiate between the effects achieved during the two stages. The differentiation between effects in all of these processes is achieved by making some alteration in the basic direct cooling process during the butt forming stage, and then discontinuing the alteration during the steady state casting stage. Never is it achieved in reverse, by altering the process during the steady state casting stage. Meanwhile, the steady state casting stage itself is no better at heat extraction than what the additional longitudinal portions of the layer of liquid coolant can extract from the body of metal after the alteration effected during the butt forming stage is discontinued. As a practical matter, this is a function of the per unit volume heat extraction rate of the respective additional longitudinal portions of the liquid coolant layer, and whatever improvement can be effected by increasing the rate of discharge in the liquid coolant, to increase the volume of the respective portions.

DISCLOSURE OF THE INVENTION

In the midst of these efforts, designers and workers in the molten metal casting art have aspired to idealize matters by reducing the rate at which heat is extracted from the body of metal during the butt forming stage of the casting operation, while at the same time maximizing the rate at which heat is extracted from the body of metal during the steady state casting stage of the casting operation. But the aspiration has remained unfulfilled. They have known that the Weber Number, that is, the rate at which atomization, mixing, and "stir" occur in the respective longitudinal portions of the liquid coolant layer, has much to do with the rate at which each of the respective portions of the layer will extract heat from the body of metal, per unit volume of the liquid coolant therein. They have also known that in general, the thinner a portion and the more "laminar" its flow, the lesser its per unit volume heat extraction rate; and the more turbulent or agitated the portion and the flow thereof, the higher its per unit volume heat extraction rate. Designers and workers in the art have also always assumed that when liquid coolant is discharged into the ambient atmosphere below a mold, and directed at the respective longitudinal sections in the body of metal being cast therein, so as to form successive longitudinal portions of a layer of liquid coolant on the surfaces of the sections, the coolant should be directed at the surfaces in relatively low angles of incidence to the axis of the mold, i.e., about 15–30 degrees to the axis, so as to minimize the amount of splash from the points of impact of the liquid coolant discharge with the surfaces, at the generally horizontal plane of the pit in which the discharge impacts the surfaces. See for example, lines 39–42 of column 1 in the patent to Goodrich. Designers and workers have observed, moreover, that at the levels of the pit immediately below the plane of impact, the discharge forms a relatively narrow circumferential band of turbulence or agitation about the respective surfaces, i.e., perhaps less than ½ inch, and that below this narrow band of turbulence, the respective longitudinal portions of the layer of liquid coolant then take on the character of laminar flow at the surfaces, until perhaps in less than another inch or so, the portions resume turbulent flow. During the butt forming stage of the casting operation, this pattern of behavior is desirable for minimal heat extraction from the body of metal, but during the steady state casting stage of the casting operation, it is no longer desirable. And yet designers and workers have found that even when the rate of discharge is increased, the initial band of turbulence changes little in width, and the character of flow below the band remains essentially that of laminar flow, followed by a renewed regime of turbulent flow below that.

In our inventive process and apparatus, we still discharge liquid coolant into the ambient atmosphere of the pit below the lower end opening of the mold, and we still form an initial longitudinal portion of a layer of liquid coolant on the outer peripheral surface of the initial longitudinal section in the body of metal as the bottom block and the initial longitudinal section in the body of metal are withdrawn from the mold and lowered through the relatively upper series of levels in the pit. Moreover, while the bottom block and first, the initial longitudinal section in the body of metal, and then the successive additional longitudinal sections in the body of metal, are being lowered through the relatively lower series of levels in the pit during the steady state casting stage of the casting operation, we still form an additional longitudinal portion of the layer of liquid coolant on each successive additional longitudinal section in the body of metal, as the respective additional longitudinal sections are withdrawn from the mold through the relatively upper series of levels in the pit. Now, however, we do what the art has been unable to do: we increase the per unit volume heat extraction rate of the respective additional longitudinal portions of the layer of liquid coolant, relative to the per unit volume heat extraction rate of the initial longitudinal portion of the layer of liquid coolant, and we do this as the respective additional longitudinal portions of the layer of liquid coolant are being formed on the corresponding additional longitudinal sections in the body of metal in the relatively upper series of levels in the pit. In this way, we are able to increase the rate at which the respective additional longitudinal portions of the layer of liquid coolant extract heat from the additional longitudinal sections in the body of metal during the steady state casting stage of the casting operation, regardless of whether any alteration was made in the rate at which the initial longitudinal portion of the layer of liquid coolant extracted heat from the initial longitudinal section in the body of metal during the butt forming stage of the casting operation. This means that we can now achieve a differential between the two stages in the most optimal fashion; and moreover, we can sharpen the differential to whatever extreme we wish. That is, using our inventive process and apparatus, we can now address both stages of the casting operation, and if desired, both at one time, say to heighten the differential between the two by, for example, using our inventive process and apparatus to increase the heat extraction rate during the steady state casting stage, while using one or more of the prior art processes to decrease the heat extraction rate during the butt forming stage.

In many of the presently preferred embodiments of our invention, we form the liquid coolant discharge into pressurized streams of liquid coolant and during the butt forming stage of the casting operation, we direct the streams of liquid coolant at the initial longitudinal section in the body of metal so that the streams impact the outer peripheral surface thereof in a generally horizontal plane of the pit, to form an initial longitudinal portion of a layer of liquid coolant on the outer peripheral surface of the initial longitudinal section, having a circumferential band of turbulence thereabout in the levels of the pit immediately below the plane of impact. Then, during the steady state casting stage of the casting operation, we increase the per unit volume heat extraction rate of the respective additional longitudinal portions of the layer of liquid coolant by forming a circumferential band of turbulence about the respective additional longitudinal portions of the layer of liquid coolant in the levels of the pit immediately below the aforesaid plane of impact, which is wider than the circumferential band of turbulence formed about the initial longitudinal portion of the layer of liquid coolant, axially of the mold. In some embodiments, moreover, we also raise the plane at which the streams of liquid coolant impact the surfaces of the additional longitudinal sections in the body of metal, relative to the plane at which the streams of coolant impacted the surface of the initial longitudinal section in the body of metal.

Preferably, we form a circumferential band of turbulence about the respective additional longitudinal portions of the layer of liquid coolant, which is coextensive with the last of the additional longitudinal sections by which the body of metal is elongated during the steady state casting stage of the casting operation. That is, the aforementioned regime of laminar flow is eliminated altogether.

In certain of the presently preferred embodiments of our invention, we form the wider band of turbulence below the plane of impact in the respective additional longitudinal portions of the layer of liquid coolant by discharging an additional fluid into the layer of ambient atmosphere of the pit immediately surrounding the outer peripheral surfaces of the respective additional longitudinal portions of the layer of liquid coolant as they are being formed on the corresponding additional longitudinal sections in the body of metal. In some embodiments, moreover, we form the additional fluid discharge into pressurized jets of fluid, and direct the jets of fluid at the additional longitudinal portions of the layer of liquid coolant so as to impact the surfaces thereof with the fluid below the plane of impact of the liquid streams.

In one group of presently preferred embodiments, we direct the respective streams of liquid coolant and jets of additional fluid at the surfaces of the respective additional longitudinal sections in the body of metal, and the surfaces of the additional longitudinal portions of the layer of liquid coolant thereon, respectively, so as firstly, to crisscross portions of the respective streams and jets with one another in the layer of ambient atmosphere of the pit immediately surrounding the surfaces of the additional longitudinal portions of the layer of coolant, and secondly, to interpose the portions of the liquid coolant streams in the paths of the portions of the jets of additional fluid, so that the portions of the liquid coolant streams are entrained in the portions of the jets and impacted on the surfaces of the additional longitudinal portions of the layer of liquid coolant by the jets.

When we form the wider band of turbulence by discharging an additional fluid into the layer of ambient atmosphere surrounding the respective additional longitudinal portions of the coolant layer, we may also interpose a mass of air borne liquid coolant spray crosswise the path of the additional fluid as the fluid is discharged into the layer of ambient atmosphere, so that the additional fluid infuses the respective additional longitudinal portions of the layer of liquid coolant with additional air entrained liquid coolant when the additional portions form on the corresponding additional longitudinal sections in the body of metal. In those embodiments, for example, wherein we form the additional fluid discharge into pressurized jets of fluid which are directed at the additional longitudinal portions of the layer of liquid coolant so as to impact the surfaces thereof, we interpose masses of air borne liquid coolant spray crosswise the paths of the respective jets of additional fluid in the layer of ambient atmosphere, so that the jets of additional fluid infuse the additional longitudinal portions of the layer of coolant with additional air entrained liquid coolant when the jets impact the surfaces of the additional longitudinal portions.

In certain embodiments, we interpose masses of air borne liquid coolant spray crosswise the paths of the respective jets of additional fluid by directing the streams of liquid coolant into the layer of ambient atmosphere of the pit immediately surrounding the respective additional longitudinal portions of the layer of liquid coolant, along such relatively high angles of incidence to the axis of the mold, that substantial portions of the respective liquid coolant streams rebound along angular paths from the surfaces of the additional longitudinal sections at the respective points of impact of the streams thereon, and form into corolla-like masses of air borne liquid coolant spray in the layer of ambient atmosphere; and at the same time, directing the jets of additional fluid along such relatively low angles of incidence to the axis of the mold from axial elevations above the plane of impact of the streams, that portions of the jets criss cross the angular paths of the corolla-like masses of air borne liquid coolant spray and entrain the spray therein to infuse the additional longitudinal portions of the layer of liquid coolant with additional air entrained liquid coolant from the corolla-like masses of spray when the jets impact the surfaces of the additional longitudinal portions.

Preferably, we discharge the respective streams and jets from an annulus circumposed about the lower end opening of the mold, and we so angularly offset the streams and jets from one another axially of the mold, and so stagger the streams and jets from one another circumferentially of the mold, that the corolla-like masses of liquid coolant spray arising from the points of impact of relatively adjacent streams of coolant, combine to form so-called "interaction fountains" of spray which shoot up directly in the paths of the jets of additional fluid. This phenomenon is reported by Slayzak et al in an article entitled EFFECTS OF INTERACTIONS BETWEEN ADJOINING ROWS OF CIRCULAR, FREE SURFACE JETS ON LOCAL HEAT TRANSFER FROM THE IMPINGEMENT SURFACE, to be published in the *Journal of Heat Transfer* of the American Society of Mechanical Engineers, and a copy of which will be provided and incorporated herein by this reference to it. In fact, we have found that when the features of this phenomenon are incorporated into our process and apparatus, the fountains of spray not only shoot up directly in the paths of the jets of additional fluid, but also in a highly air-filled condition, so that when entrained in turn by the jets of additional fluid, the jets produce an extraordinary degree of turbulence in the additional layers of liquid coolant, and this in turn produces a remarkable increase in the per unit volume heat extraction rate of the respective layers.

We commonly direct the streams of liquid coolant at the surfaces of the respective additional longitudinal sections in the body of metal along angles of incidence in the range of 30–105 degrees to the axis of the mold. We direct the jets of additional fluid at the surfaces of the additional longitudinal portions of the layer of liquid coolant along angles of incidence in the range of 15–30 degrees to the axis of the mold.

As indicated earlier, we may also vary the initial longitudinal portion of the layer of liquid coolant formed on the initial longitudinal section in the body of metal in the butt forming stage of the casting operation, in some manner designed to reduce the per unit volume heat extraction rate thereof.

Furthermore, where our mold is adapted to form a body of metal having a polygonal cross section transverse the axis thereof, such as when we form sheet ingot, we may also increase the per unit volume heat extraction rate of the initial longitudinal portion of the layer of liquid coolant formed on opposing sides of the initial longitudinal section in the body of metal, such as on the opposing ends of the butt of the rectangular cross section of our ingot. In this way, we can achieve a differential between opposing pairs of sides of the body of metal during the butt forming stage, such as between the opposing sides of the butt, on one hand, and the opposing ends of it, on the other.

We may use a gas or additional liquid coolant as the additional fluid. One advantage in using additional liquid coolant is that of simplifying the mold. Liquid is also easier to control; and the use of it makes it easier to achieve uniformity from one mold to another, as well as within each mold, when a multiplicity of molds is employed. On the other hand, when using a gas, the same gas can be employed in any one of the various prior art techniques for reducing the mass flow rate of the liquid coolant during the butt forming stage of the casting operation.

Another advantage in using additional liquid coolant as the additional fluid, is that during the butt forming stage of the casting operation, the additional liquid coolant can be discharged onto the initial longitudinal section in the body of metal to form the initial longitudinal portion of the layer of liquid coolant thereon. In fact, in certain presently preferred embodiments of the invention, the first mentioned liquid coolant and the additional liquid coolant are discharged from the mold itself through a first and second series of spaced holes therein which are circumposed about the lower end opening of the mold in an annulus thereof, and connected with a pair of pressurized liquid coolant supply chambers in the body of the mold, so that sets of primary and secondary liquid coolant streams can be discharged from the first and second series of holes, respectively, and either directed at the respective additional longitudinal sections in the body of metal, and the respective additional longitudinal portions of the layer of liquid coolant on the surfaces thereof, respectively, so as to cool the body of metal during the steady state casting stage of the casting operation, or alternatively, selectively turned on and off at the respective supply chambers therefor, by controlling the flow of liquid coolant to the respective chambers, so that if desired, during the butt forming stage of the casting operation, only the secondary liquid coolant is directed at the initial longitudinal section in the body of metal to form the initial longitudinal portion of the layer of liquid coolant thereon.

In some of these last mentioned embodiments, the first and second series of holes are so angularly offset from one another axially of the mold, and the first series of holes is so more steeply inclined axially of the mold than the second series, that the respective chambers for supplying liquid coolant to the first and second series of holes, can be relatively superposed above one another in the body of the mold. Preferably, however, the chambers are interconnected by a valve so that liquid coolant can be supplied to the relatively upper chamber for delivery to both the first and second series of holes, but only supplied to the relatively lower chamber through the valve, when the steady state casting stage of the casting operation is commenced.

In certain embodiments for producing ingot, the relatively lower chamber is subdivided into end sections and side sections, and the end sections are directly interconnected with the relatively upper chamber through open passages therebetween, while the side sections are interconnected with the relatively upper chamber through valves, so that liquid coolant is supplied to the end sections of the lower chamber at the same time as it is supplied to the upper chamber, to direct cool the ends of the ingot during both the butt forming stage and the steady state casting stage of the casting operation.

BRIEF DESCRIPTION OF THE DRAWINGS

These features will be better understood by reference to the accompanying drawings wherein we have illustrated one of the last mentioned embodiments of our invention which employs a coolant discharging mold that is double chambered, but partially subdivided for cooling the ends and sides of sheet ingot differently.

In the drawings.

BEST MODE FOR CARRYING OUT THE INVENTION

Figure 1:
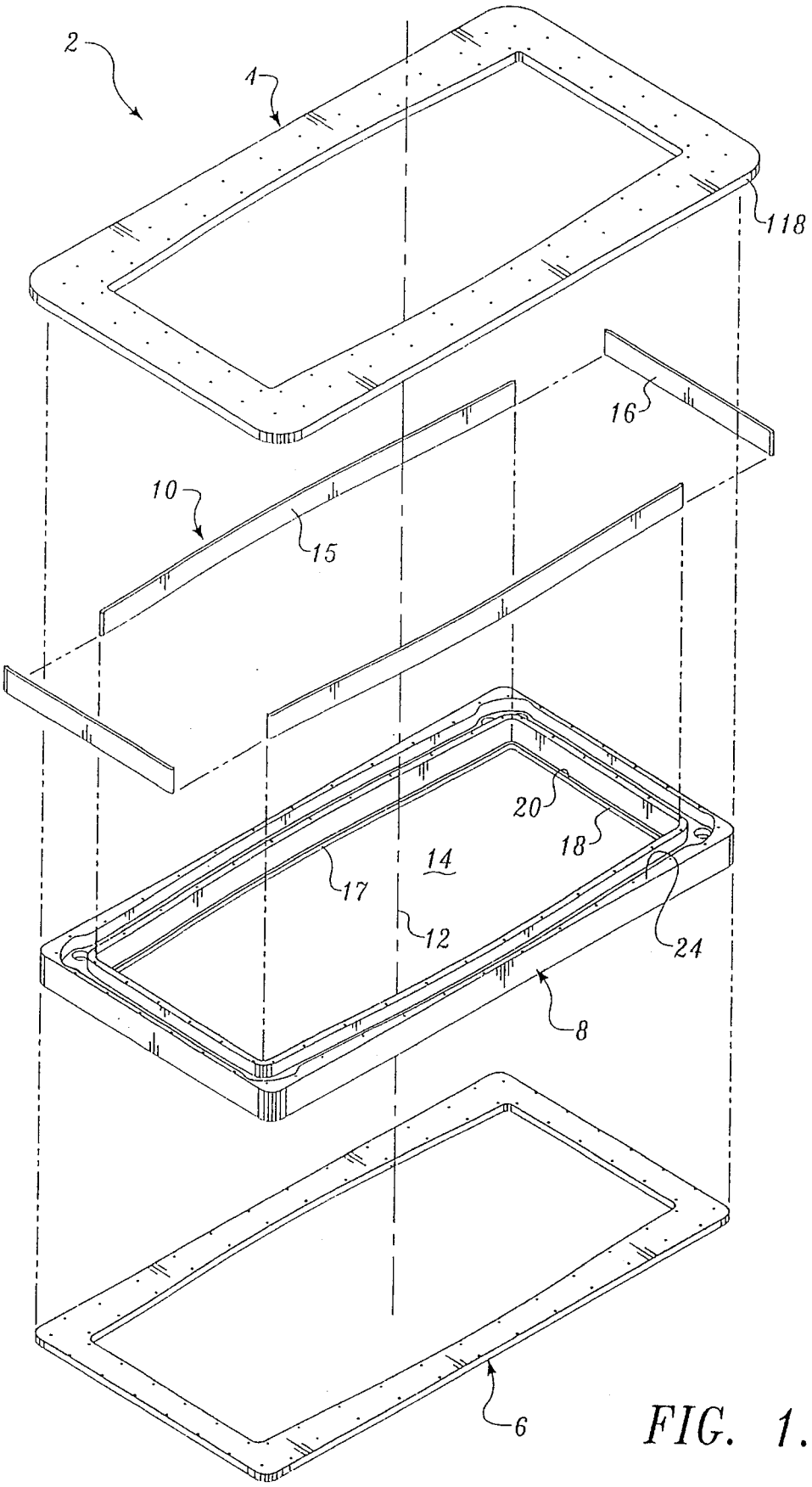
FIG. 1 is an exploded top perspective view of the main body components of the mold.
Figure 2:
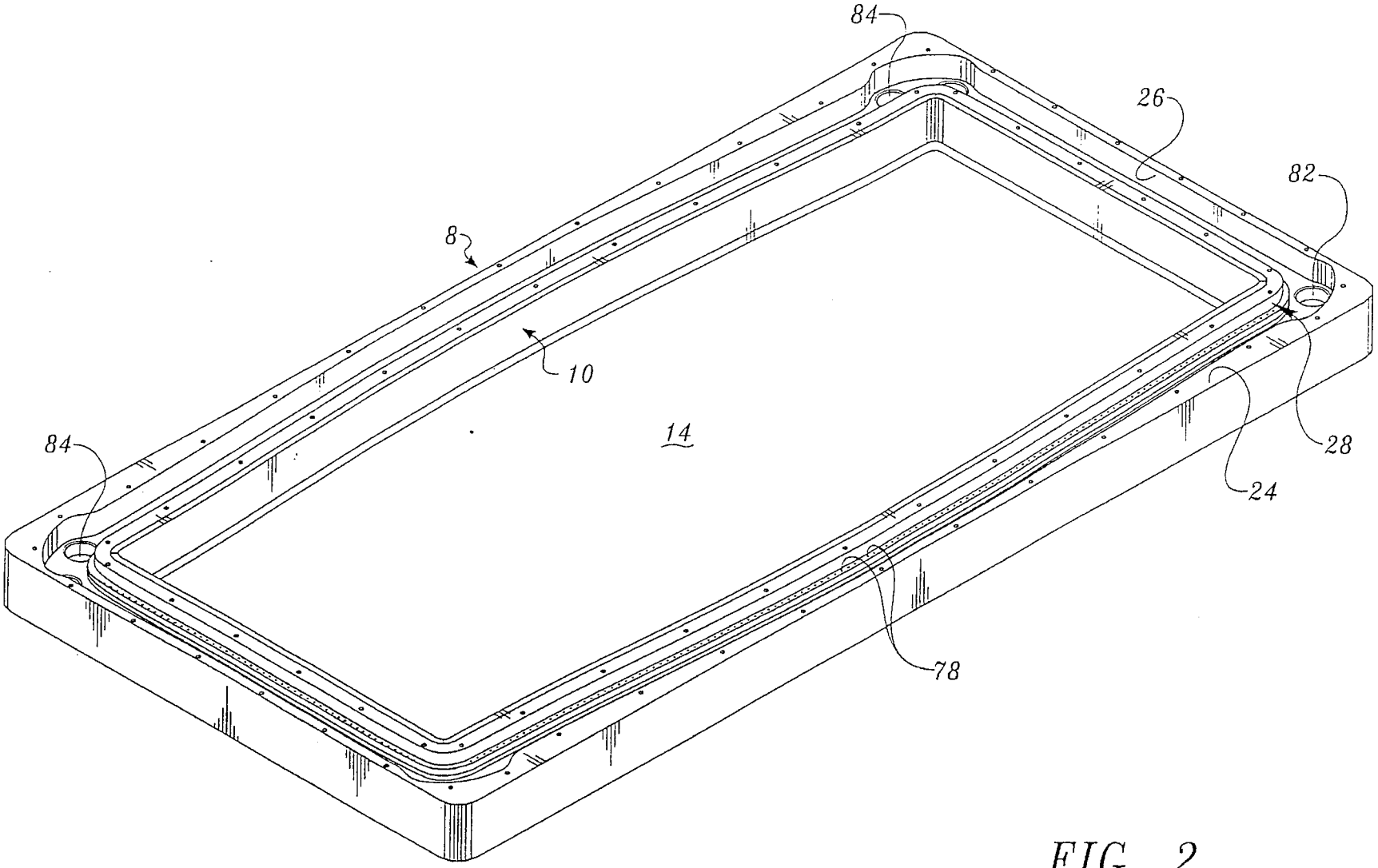
FIG. 2 is a relatively enlarged and assembled top perspective view of two intermediate body components, i.e., an annular case and a graphite casting ring circumposed about the inner periphery thereof.
Figure 3:
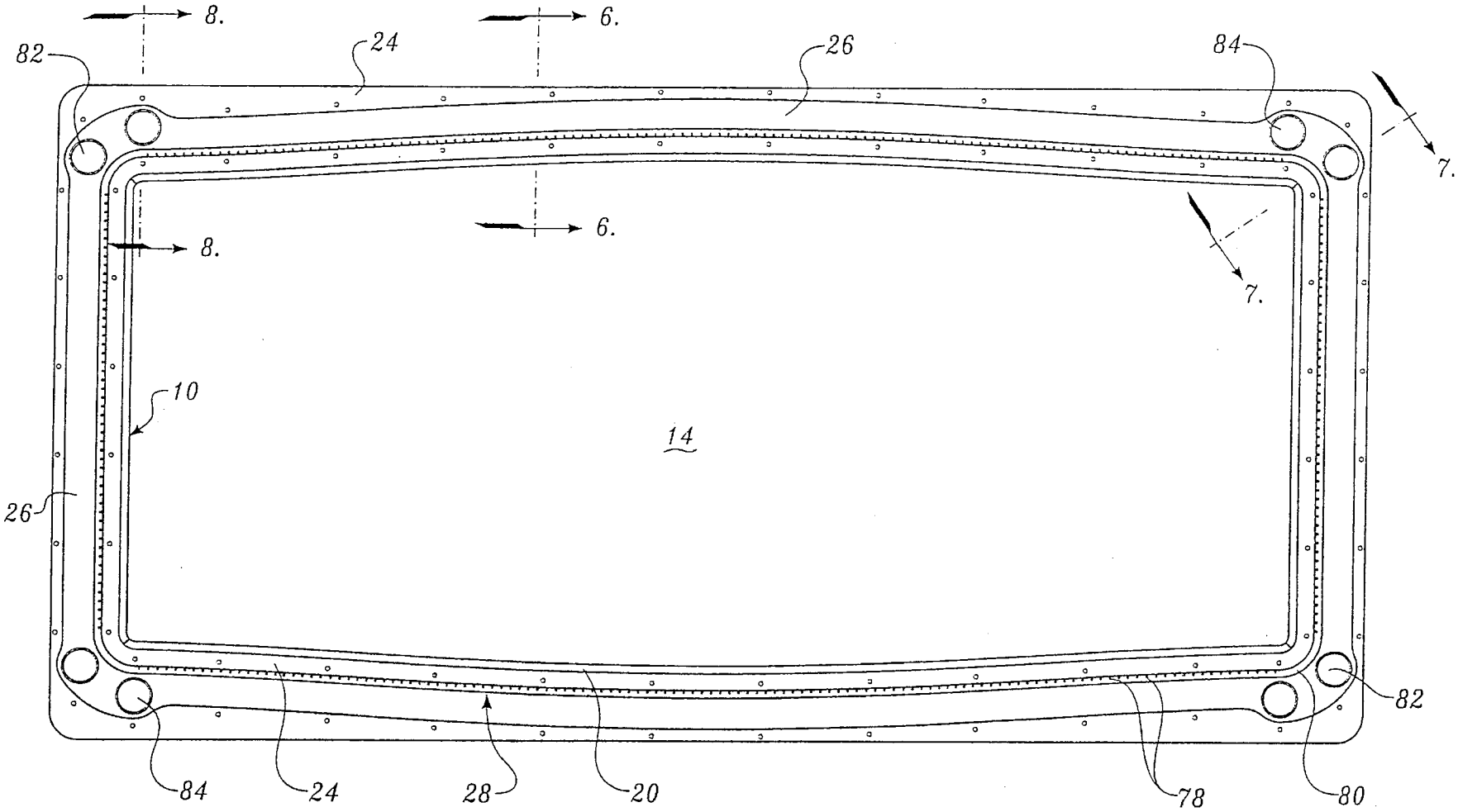
FIG. 3 is a similarly enlarged top plan view of the case and ring assembly.
Figure 4:
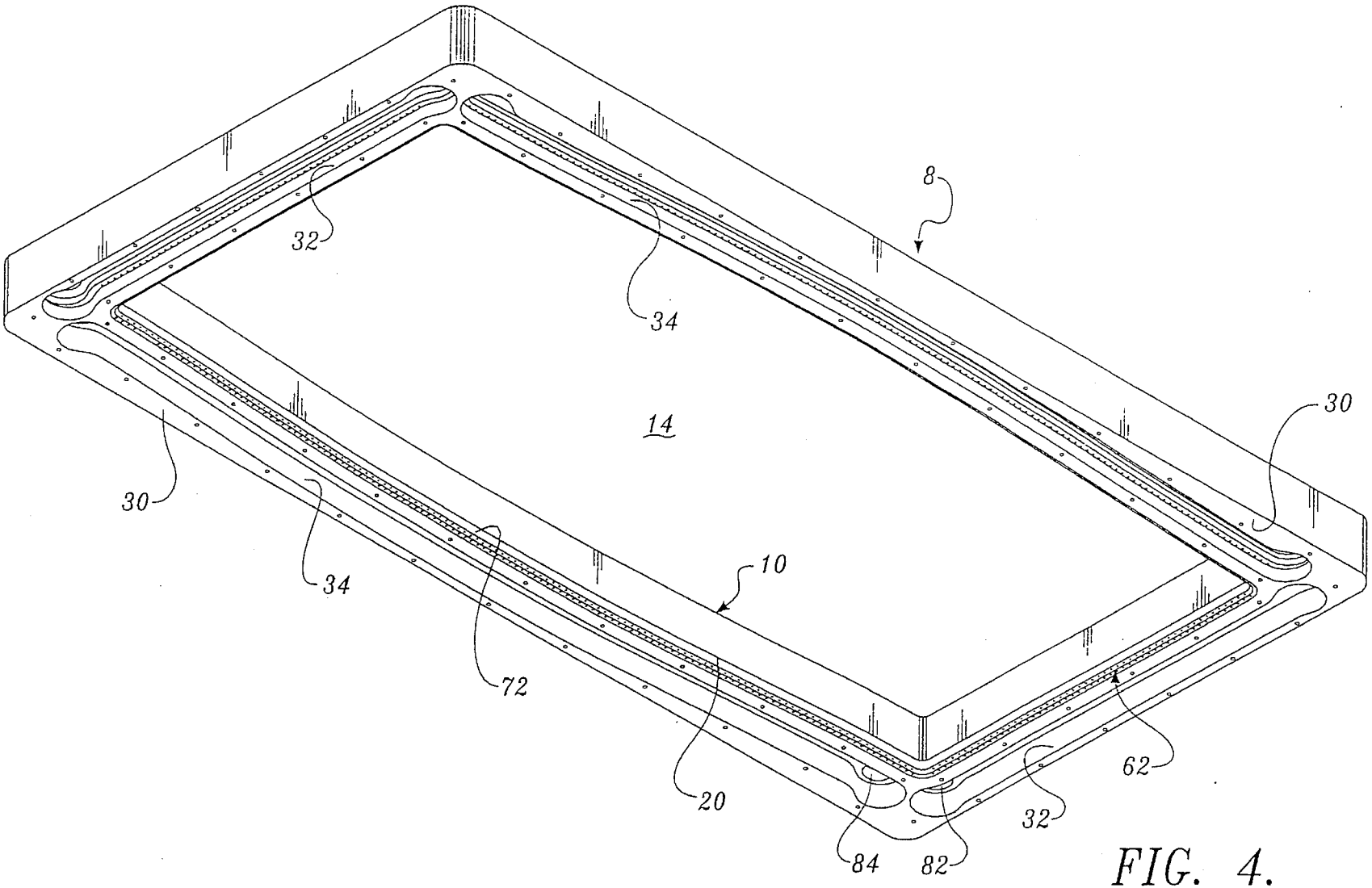
FIG. 4 is a similarly enlarged bottom perspective view of the case and ring assembly.
Figure 5:
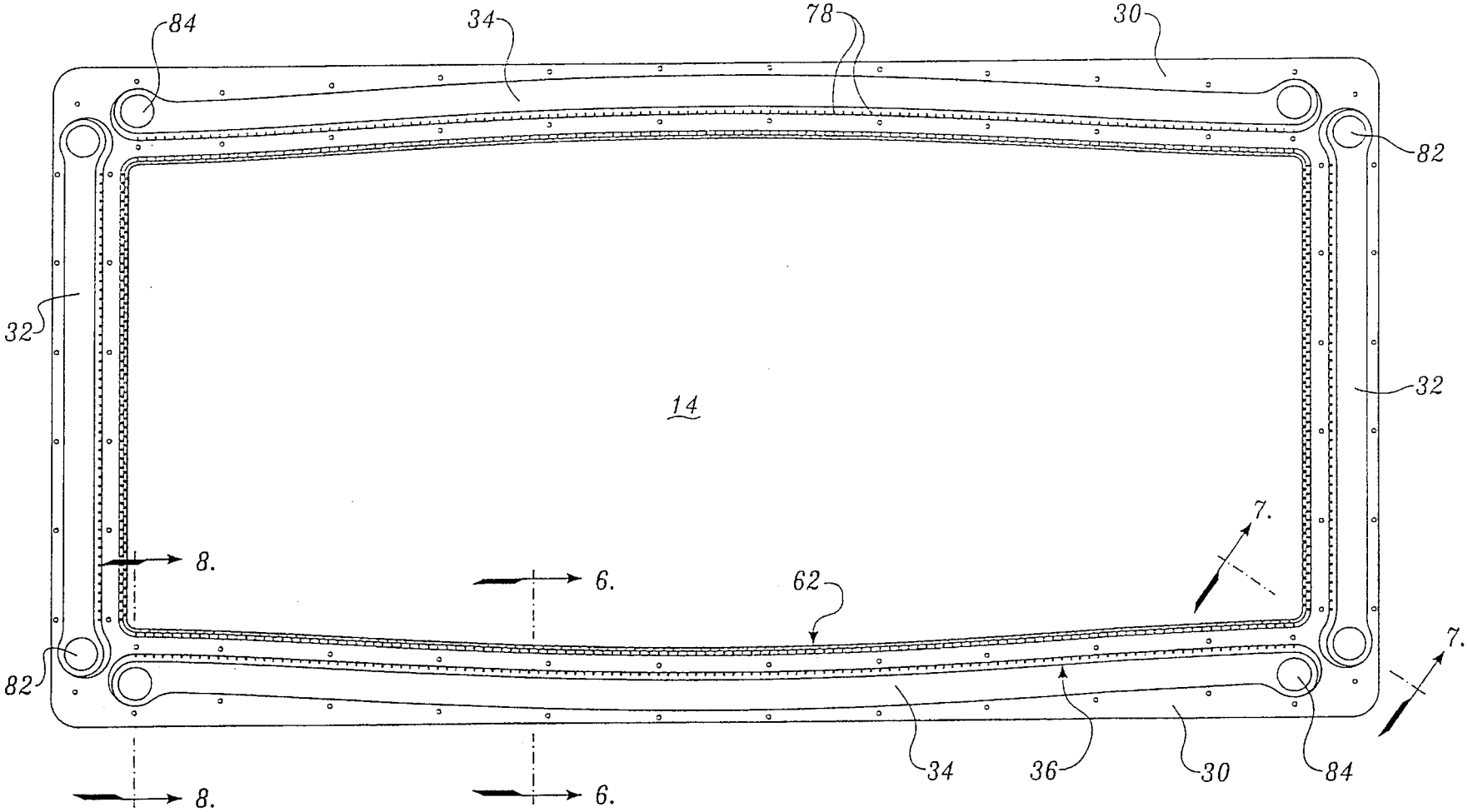
FIG. 5 is a similarly enlarged bottom plan view of the case and ring assembly.
Figure 6:
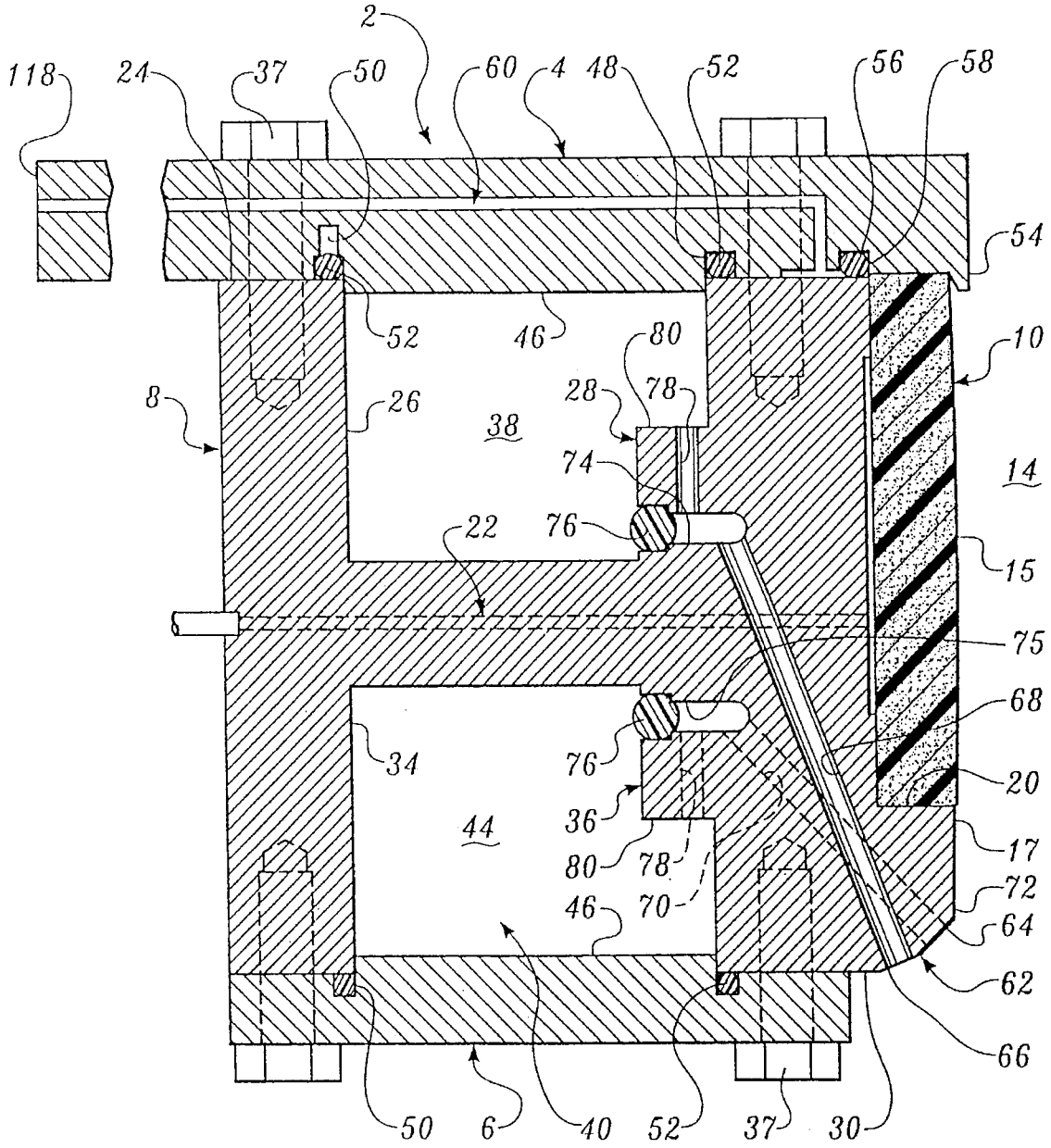
FIG. 6 is a cross section of the mold as a whole taken along the line 6—6 of FIGS. 3 and 5.
Figure 7:
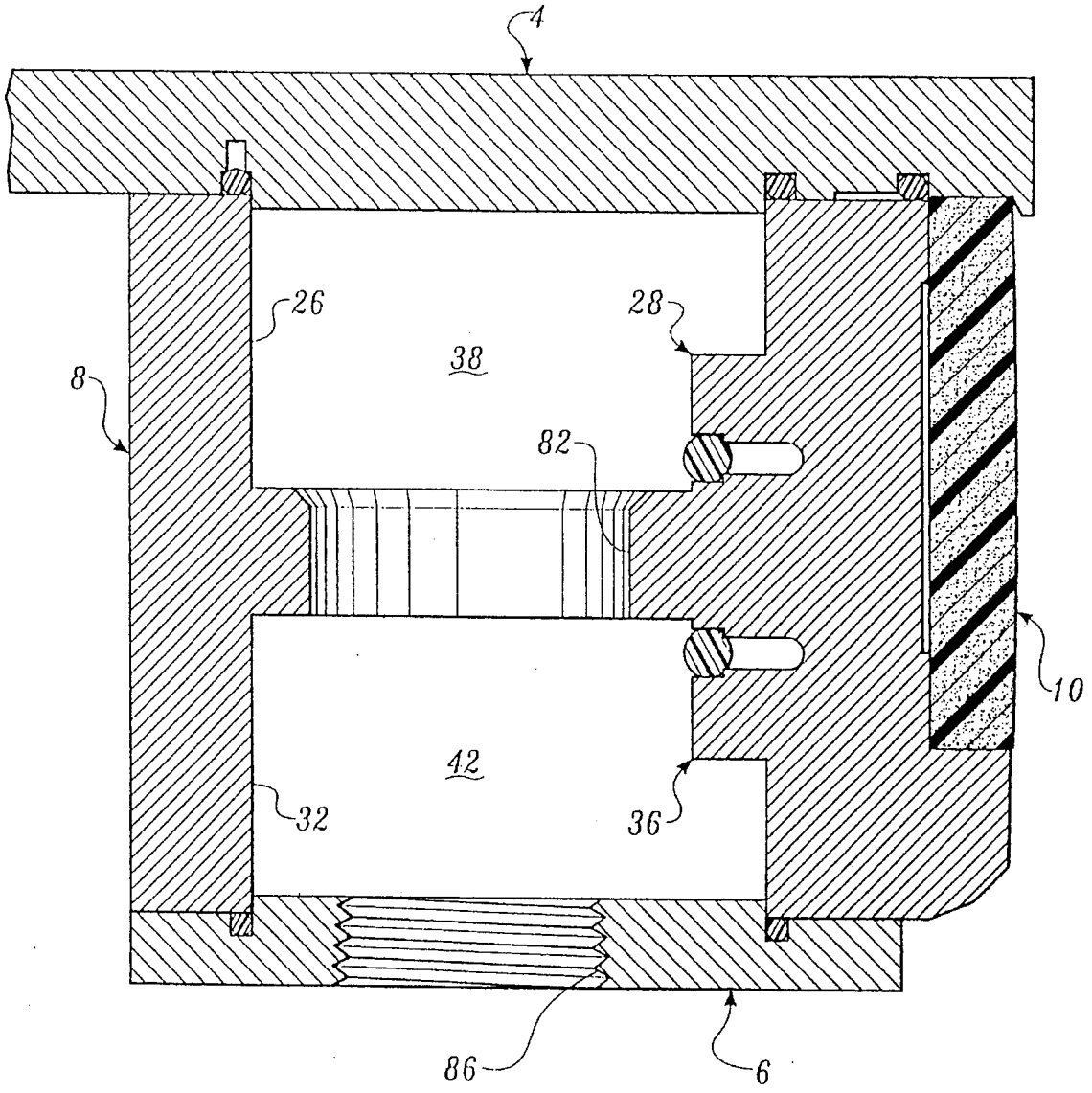
FIG. 7 is a cross section of the mold as a whole taken along the line 7—7 of FIGS. 3 and 5.

Referring first to FIGS. 1–8, it will be seen that the body of the mold 2 comprises a pair of annular top and bottom plates 4 and 6 respectively, an annular case 8 which is interposed between the plates to form the principal casting component of the mold, and a segmented graphite ring 10 which is circumposed about the inner periphery of the case to form the casting surface thereof. The plates, the case, and the casting ring are all rectangular in cross section transverse the vertical axis 12 of the mold, and the open ended cavity 14 formed within the ring is similarly cross sectioned transverse the axis of the mold, consistent with the mold being adapted to form sheet ingot. The opposing sidewalls 15 and end walls 16 of the ring are relatively convex and flat, moreover, to lend themselves to this function, as are the respective side walls 17 and end walls 18 of the case. The latter walls are also rabbetted at the tops thereof to provide a seat 20 for the casting ring. The ring 10 is seated around the perimeter of the cavity in a manner illustrated in U.S. Pat. No. 4,947,925, and is serviced by oil and gas for the purposes described in U.S. Pat. No. 4,598,763. The services are illustrated only schematically at 22 (FIG. 6), however, as is the seating of the ring, inasmuch as the details of both features can be obtained from the foregoing patents.

At the top surface 24 thereof, the case 8 has an annular recess 26 formed therein, and the recess has an annular step 28 formed in the bottom thereof at the inner periphery of the recess. At its bottom surface 30, the case has a pair of part annular recesses 32 and 34 formed in the opposing ends and sides thereof, and once again, each recess 32 or 34 has an annular step 36 formed in the bottom of it at the inner periphery of the recess. Using bolts 37, the annular plates 4 and 6 are lag-bolted to the respective surfaces 24 and 30 of the case, to cover the respective recesses therein, and to form a pair of relatively superposed chambers 38 and 40 in the top and bottom of the case, the upper of which, 38, is annular, and the lower of which, 40, is subdivided into part annular sections 42 and 44 at the ends and sides of the case, respectively. Moreover, to aid in sealing the respective chambers, each plate 4, 6 is rabbeted about the inner and outer peripheries thereof, so as to have an intermediate land or lands 46 which can be telescoped within the opposing recess 26 or recesses 32, 34 when the plates are applied to the case. In addition, each plate is given a pair of circumferentially extending grooves 48, 50 about the land or lands thereon, in which elastomeric O-rings 52 are seated to seal the joints between the respective plates and the case, at the inner and outer peripheries of each land, when the plates are applied to the case. The top plate 4 is sufficiently narrow at the opening thereof, to overlie the graphite casting ring 10, and to form a narrow lip 54 at the inner periphery thereof above the ring. A third elastomeric O-ring 56 is seated in a third groove 58 about the circumference of the top plate at the joint between it and the casting ring, and the features of a leak diversion scheme such as that described in U.S. Pat. No. 4,597,432, are incorporated in the top plate and represented schematically at 60 to protect the joint against the incursion of leakage from the upper chamber.

The bottom plate 6, meanwhile, is sufficiently broad at the opening thereof, that the inner periphery of the plate is offset radially outwardly from the walls 17, 18 of the case, to expose an annulus 62 of the case at the lower inner peripheral corner thereof. The upper half of the annulus is mitered in turn, at 45 degrees to the axis of the mold, and the lower half is mitered at 67.5 degrees to the axis of the mold, and to a greater depth radially outwardly thereof, so that the annulus has a pair of axially and radially offset surfaces 64 and 66 thereon. The surfaces in turn have two series of spaced holes 68 and 70, respectively, in them, which are circumposed about the lower end opening 72 of the cavity in the annulus, for the discharge of primary and secondary liquid coolant streams from the mold, as shall be explained.

Referring now to the respective chambers 38, 40 of the case, it will be seen that a circumferential groove 74 or 75 is deeply removed from the inner peripheral wall of the step 28 or 36 in each chamber, and is rabbetted about the mouth thereof to receive an annular sealant ring 76 of considerably larger diameter than those used at the joints of the assembly. Also, a series of spaced holes 78 is drilled in the shoulder 80 of each step, to open into the corresponding groove 74 or 75 thereof, and to provide constricted flow to it from the corresponding chamber, as a form of baffle for the chamber. The respective series of holes 68 and 70 in the lower inner peripheral corner of the case are then drilled into the bottoms of the grooves 74 and 75, from the mitered surfaces 64, 66 of the annulus 62, and at right angles thereto, so that the series of holes have 22.5 degree and 45 degree angles, respectively, to the axis 12 of the mold. The holes in the respective series of holes are staggered about the circumference of the mold, however, so that the holes in one series of holes are circumferentially offset from the holes in the other series of holes, and vice versa, and each extend through the intervals of space between the pairs of holes in the other series of holes. See FIGS. 6 and 8–15.

Figure 8:
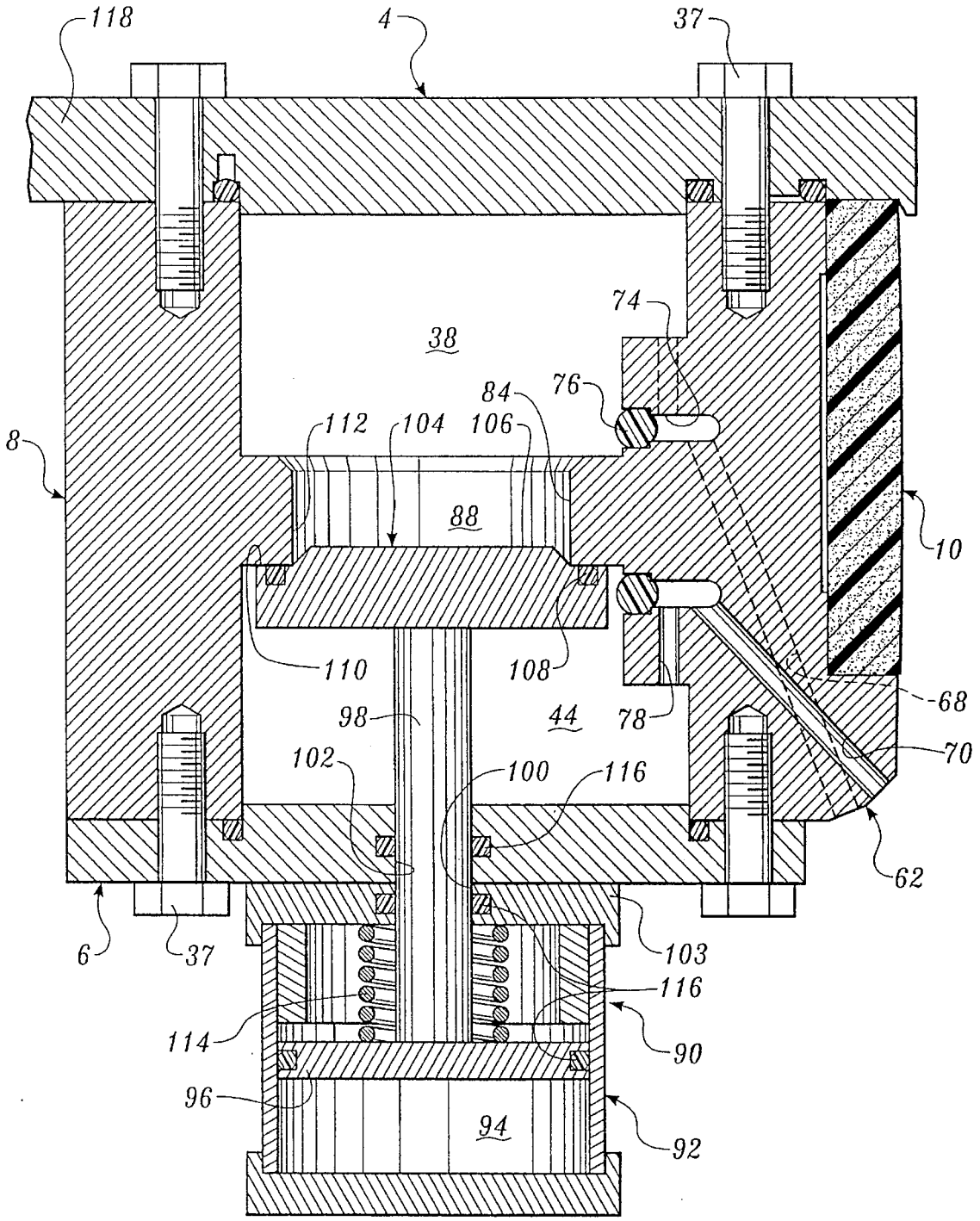
FIG. 8 is a cross section of the mold as a whole taken along the line 8—8 of FIGS. 3 and 5, and also showing one of a set of devices which may be used for opening and closing a set of valves interconnecting the side sections of the relatively lower chamber with the relatively upper chamber in the body of the mold.

Referring now to FIGS. 1–5, 7 and 8 in particular, it will be seen that the case 8 of the mold has two sets of vertical passages 82 and 84 therethrough, which open into the upper and lower chambers thereof, at points adjacent the respective corners of the case. One set of passages, those seen at 82, interconnects the end sections 42 of the lower chamber 40 with the upper chamber 38, and vice versa, and at the opposing ends of the end sections 42 crosswise of the mold. The other set of passages, those seen at 84, interconnects the side sections 44 of the lower chamber with the upper chamber and vice versa. A threaded opening 86 is provided below each passage 82, and at each corner of the mold, in the bottom plate 6 thereof, to receive the male fitting (not shown) of a pressurized water source, with which to charge the end sections 42 of the lower chamber and the entire upper chamber 38 with pressurized liquid coolant. Given the passages 84 between the upper chamber and the side sections 44 of the lower chamber, the pressurized coolant can also access the side sections of the lower chamber. However, these passages 84 are outfitted as valves 88 so that the pressurized coolant in the upper chamber can be admitted to the side sections of the lower chamber selectively, that is, in an on/off fashion when desired. As seen in FIG. 8, a valve closure device 90 is mounted under each passage 84, on the bottom plate. The device 90 is operable to open and close the respective passage to flow, and comprises a cylindrical housing 92 having a cylindrical chamber 94 formed therewithin, on a vertical axis. A piston 96 is slideably engaged in the chamber to be raised and lowered axially thereof, and the piston has a rod 98 upstanding thereon, the shank of which is slideably inserted in the respective side section 44 of the lower chamber, through opposing holes 100 and 102 in the top 103 of the housing and the adjacent corner of the bottom plate, respectively. The rod 98 in turn has a valve closure disc 104 at the top thereof in the corresponding side section 44 of the lower chamber, and the disc is rabbetted and chamfered at the upper side 106 thereof, and equipped with an elastomeric O-ring 108 in the shoulder 110 of the rabbet, to seal with the bottom opening 112 of the passage, and close the same under the action of the piston. The piston is accompanied, however, by a helical spring 114 which is circumposed about the rod thereon, in the chamber 94 of the housing, between the piston and the top 103 of the housing. Fluid is supplied to the underside of the piston through an opening (not shown) in the housing and when the passage 84 is to be closed, the chamber 94 in the housing is pressurized with the fluid to raise the piston against the bias of the spring 114 until the disc 104 is engaged in the opening 112 of the passage to close the same. When the passage is to be opened, the fluid is released to allow the piston to retract under the bias of the spring, and thus disengage the disc from the opening of the passage. Normally, the fluid is released slowly to open the passage in a gradual manner, as shall be explained.

Additional elastomeric O-rings 116 are provided around the periphery of the piston, and around the shank of the rod 98 at each of holes 102, 100 in the plate 6 and the top 103 of the housing.

Preferably, each inlet formed above the openings 86, is screened and monitored in a manner illustrated in U.S. application Ser. No. 07/970,686, filed Nov. 4, 1992, with the title ANNULAR METAL CASTING UNIT, and now U.S. Pat. No. 5,323,841.

As seen in FIG. 1 and in FIGS. 6–10, the top plate 4 is sufficiently wide at the outer periphery thereof to provide a flange 118 about the body of the mold, and when the mold is put to use, it is inserted in an aperture (not shown) in a casting table and rested on the table with the flange 118 thereof being used to support the mold in the aperture. The table in turn is supported over a casting pit 120 (FIG. 9) which is equipped with a bottom block 122 that is reciprocable along the axis 12 (FIG. 1) of the mold, and initially cooperatively telescopically engaged with the lower end opening 72 of the mold. With the commencement of the casting operation, and as molten metal is poured through the mold at the cavity 14 thereof, the bottom block 122 is lowered downwardly of the axis, through a succession of successively lower levels in the pit. Referring to FIGS. 9–15, it will be seen that first, the pouring step and the attendant movement of the bottom block, operate to form an initial longitudinal section 124 in the body of the ingot to be cast, commonly called the "butt" of the ingot. During this time, however, the bottom block is lowered only through an upper series 126 of levels in the pit, perhaps for a total of 6–12 inches of drop therein. Thereafter, as the pouring step continues, and as the downward movement of the bottom block continues, the body of the ingot is elongated with additional longitudinal sections 128 (FIG. 10) as the bottom block is lowered through a relatively lower series (not shown) of levels in the pit, below the upper series 126. This is commonly called the steady state casting stage of the casting operation. Throughout this time, during both stages, the outer peripheral surface 130 of the body of the ingot is progressively exposed to the ambient atmosphere of the pit below the mold, as the respective longitudinal sections 124 and 128 in the body of the ingot are withdrawn from the mold through the relatively upper series 126 of levels in the pit. Moreover, to direct cool the respective longitudinal sections in the body of the ingot as they are withdrawn from the mold, liquid coolant 132 is discharged onto the surface of each section as it emerges from the mold. This was discussed earlier, and as indicated then, it is at this point that the invention comes into play.

Figure 9:
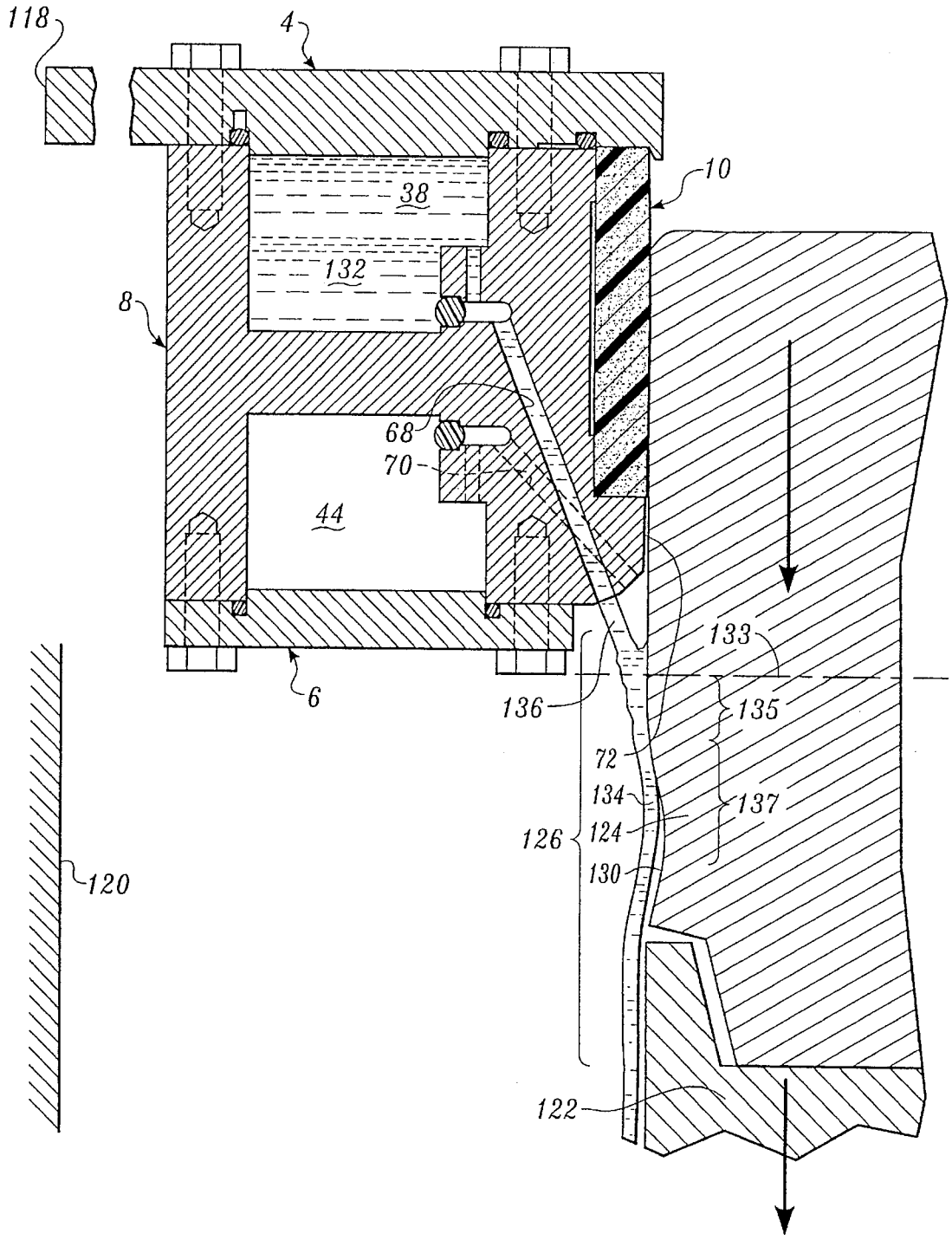
FIG. 9 is a cross section similar to FIG. 6, but also illustrating in part the pit, the bottom block, and the butt forming stage of our direct cooling process when the bottom block has been cooperatively engaged with the mold at the lower end opening thereof, and then lowered through a series of upper levels in the pit as molten metal is poured through the mold and while both sets of the liquid coolant streams are discharged onto the ends of the ingot in the manner of FIG. 10, only one set of the streams is discharged onto the sides of the ingot in the manner of FIG. 9, to form the initial longitudinal portion of a layer of liquid coolant on the butt of the ingot, which is differentiated as to its cooling effect on the respective ends and sides of the ingot.
Figure 10:
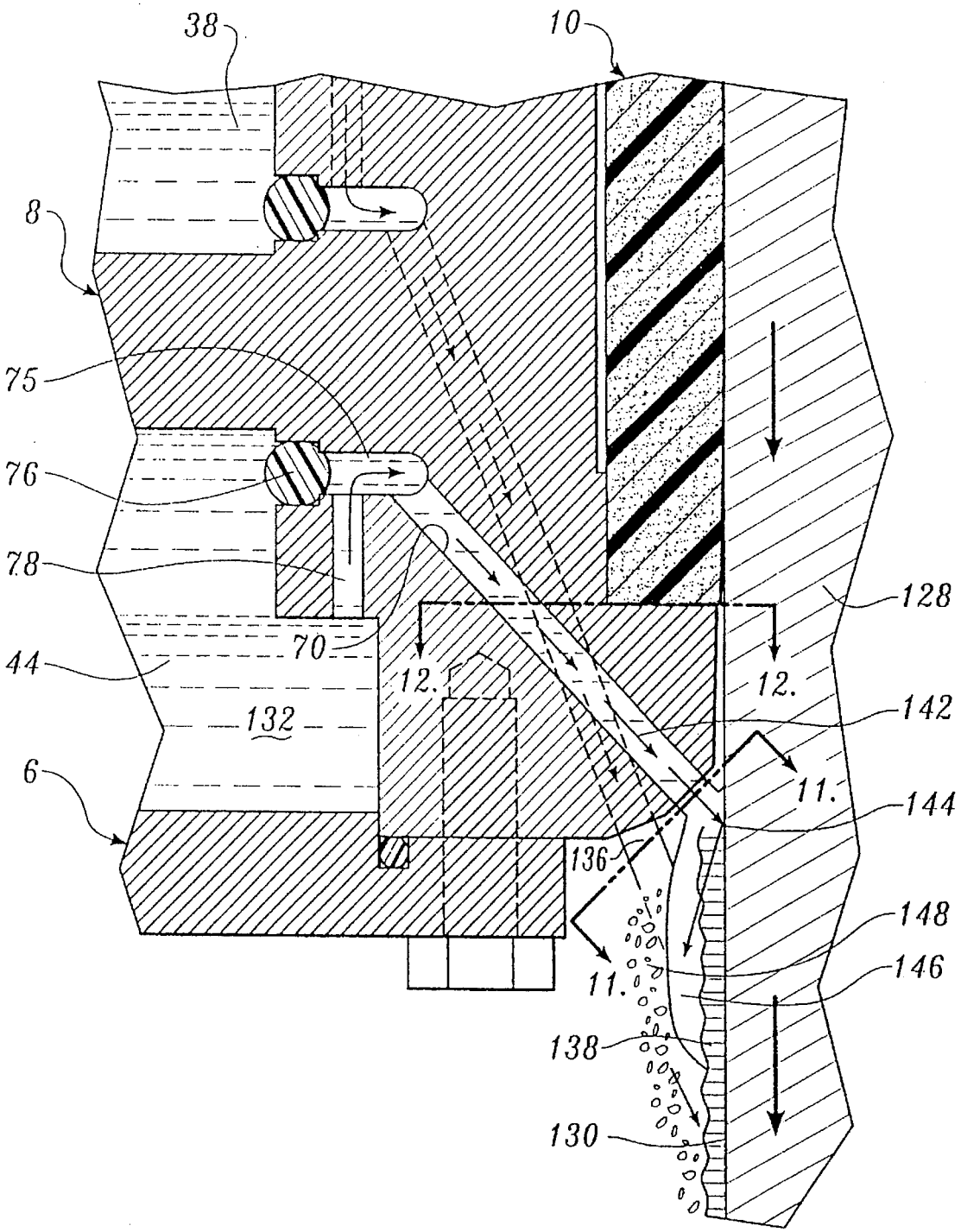
FIG. 10 is a part schematic, part cross sectional view of the mold taken at the same site as FIG. 9, but when the valves have been opened to introduce liquid coolant to the side sections of the lower chamber as well, so that two sets of liquid coolant streams are now discharged onto the sides of the ingot, portions of which crisscross one another in the layer of ambient atmosphere surrounding the layer of liquid coolant on the sides of the ingot, because the streams from the lower chamber undergo "bounce" or rebound from the sides of the ingot, and form into corolla-like masses of air borne liquid coolant spray which not only "mushroom" from the sides of the ingot in paths crosswise the paths of the upper chamber streams, but also "mushroom" so close to one another that the "interaction fountains" formed therebetween shoot up into the paths of the upper chamber streams and are entrained by the upper chamber streams and conveyed with them onto the surfaces of the successive additional layers of liquid coolant formed on the sides of the ingot in what is now the steady state casting stage of the casting operation.
Figure 11:
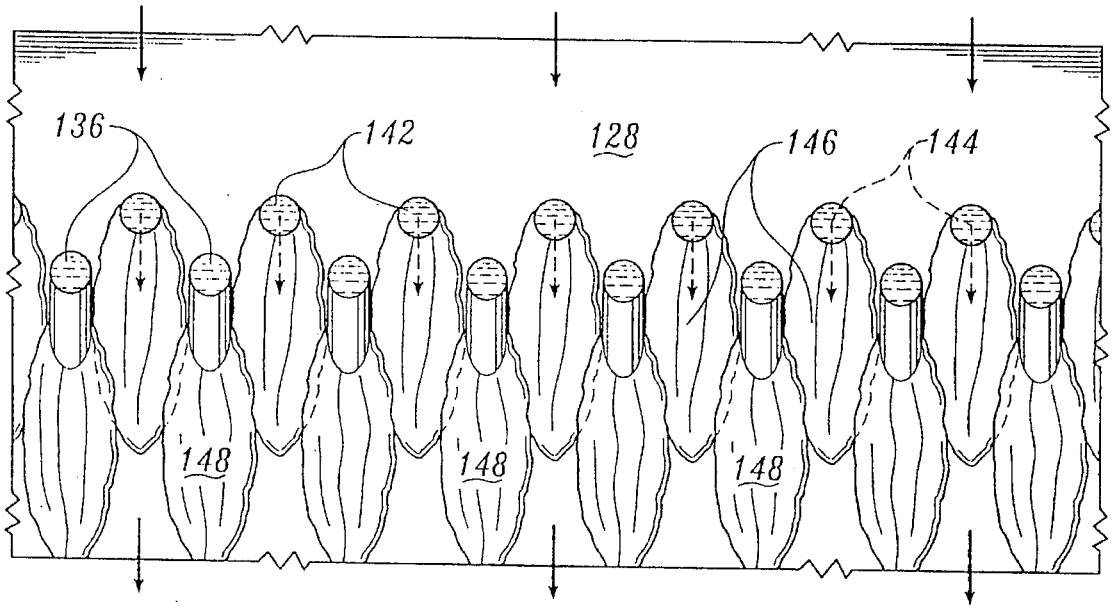
FIG. 11 is a part schematic, part cross sectional view taken along the line 11—11 of FIG. 10.
Figure 12:
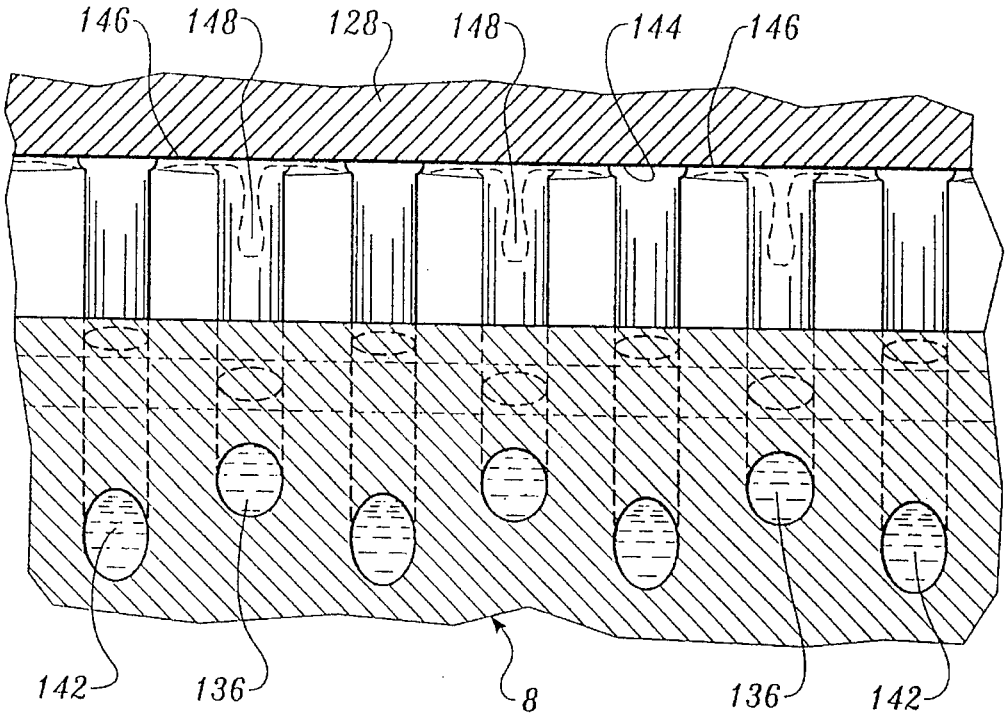
FIG. 12 is a further part schematic, part cross sectional view taken along the line 12—12 of FIG. 10.

Referring again to FIG. 9, it will be seen that during the butt forming stage of the casting operation, the upper chamber 38 of the mold—and though not shown, the end sections 42 of the lower chamber as well—are charged with pressurized liquid coolant 132. The coolant is discharged onto the sides and ends of the emerging ingot, though through only the 22.5 degree holes 68 in the mold at the sides of the ingot, while through both the 2.5 degree holes 68 and the 45 degree holes 70 at the ends of the ingot. The discharge on the sides is seen in FIG. 9, and the discharge on the ends in FIG. 10. Ignoring the ends for the moment, and referring first to FIG. 9, it will be seen that the discharge on the sides forms an initial longitudinal portion 134 of a layer of liquid coolant which is formed on the surface 130 of the sides as the bottom block 122 is lowered through the upper series 126 of levels in the pit. The initial longitudinal portion 134 originates at a horizontal plane of the pit, seen generally at 133, where the streams 136 of coolant from the holes 68 impact the surface 130 of the sides of the ingot. As explained earlier, and as is well known in the art, at levels immediately below the plane of impact 133, a narrow circumferential band 135 of turbulence arises in the liquid coolant portion 134, and this in turn is followed by a somewhat wider laminar flow regime 137, vertically downward from it. Thereafter, the coolant resumes turbulent flow as it continues to flow by gravity downward along the length of the newly emerged section 124 in the ingot. And in the meantime, on the surface 130, the laminar flow regime is thin and subject to film boiling, qualities which are desirable for the butt forming stage, to minimize "butt curl," but which are not desirable for the steady state casting stage of the casting operation, when the maximum cooling efficiency is desired.

Cooling efficiency is commonly equated with turbulent flow and vice versa, since the more turbulent the flow, the higher the Weber Number. If the butt forming stage were completed and the steady state casting stage of the casting operation were commenced with only the streams 136 as a means for cooling the successive additional longitudinal sections 128 in the body of the ingot, each successive additional longitudinal portion 138 of the layer of liquid coolant formed thereon would have a narrow band of turbulence below the plane of impact 133, but the band would have limited capacity to extract heat from the body of the ingot before the task of doing so had to be assumed by the laminar flow regime. Ironically, the levels of the pit coinciding with the regimes 135 and 137, are the best time to extract heat from the body of the ingot, since it is at its hottest outside of the mold. Yet, as explained, there has been no way known to capitalize on this opportunity. The rate of coolant discharge can be increased as the steady state stage commences, but this has very limited effect and does nothing to improve the per unit volume heat extraction rate of the respective portions of the liquid coolant layer in the regimes 135, 137. Meanwhile, for each inch of drop below its meniscus, the body of the ingot experiences approximately an 800 degree F. drop in temperature, and the opportunity to extract heat at the optimum time is rapidly lost.

The invention changes this by providing a means and technique for increasing the per unit volume heat extraction rate of the successive additional portions 138 (FIG. 10) of the liquid coolant layer formed on the surface 130 during the passage of the body of the ingot through the regimes 135, 137 in the steady state casting stage of the casting operation. In brief, the band 135 is widened, both downwardly and upwardly of the axis of the mold, and in fact, widened downwardly to the extent of eliminating the laminar flow regime 137 altogether. The effect was actually achieved during the butt forming stage of the casting operation, but only at the ends of the ingot, where liquid coolant was also discharged from the 45 degree holes 70, to impact the ends of the ingot. This was done because of the character of the butt curl phenomenon crosswise the wider dimension of the ingot, versus the narrower dimension thereof. But inasmuch as the effect lengthwise of the ingot has been selected for illustration in FIGS. 9–15, the description hereafter will be directed to it alone, notwithstanding that the same effect was achieved on the ends of the ingot during the butt forming stage of the casting operation.

At the close of the butt forming stage, the passages 84 are opened, using the devices 90, and liquid coolant 132 is released into the side sections 44 of the lower chamber to begin discharging through the 45 degree holes 70 in the side sections of the annulus 62. As the added discharge builds up, and as the streams 142 of coolant exiting through the 45 degree holes 70 impact the sides of each successive additional longitudinal section 128 of the ingot in the manner of FIGS. 9–15, substantial portions of the respective 45 degree streams 142 rebound from the surfaces 130 of the additional longitudinal sections 128 at the respective points 144 of impact of the streams 142 thereon. When air borne, moreover, the portions mushroom into corolla-like masses of liquid coolant spray 146 which crisscross between the 22.5 degree streams 136 of liquid coolant traversing the layer of ambient atmosphere immediately surrounding the additional longitudinal portion 138 of the liquid coolant layer currently on the ingot. In this layer of surrounding atmosphere, the masses of spray 146 are entrained in turn by the streams 136 of liquid coolant, and the liquid coolant in the streams 136 is infused in turn with the air and liquid of the spray as the streams rush toward and impact the surface of the portion 138. Consequently, in addition to surrounding the surface of each portion 138 with additional fluid, and agitating the surface with the force of their impact, the streams 136 also infuse the portions 138 with a considerable volume of air as they generate turbulence in them.

To minimize the shock of the added coolant, however, the passages 84 are commonly opened slowly, so as to release the added coolant into the side sections 44 of the lower chamber gradually.

Figure 13:
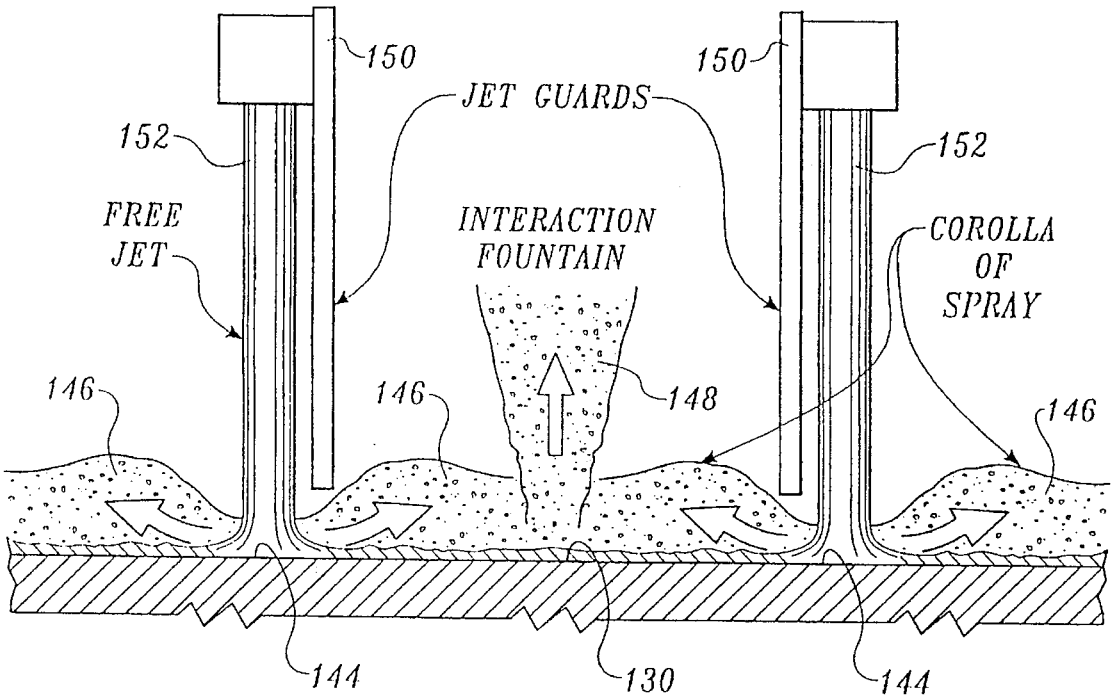
FIG. 13 is a schematic illustration of the "interaction fountain" effect observed by Slayzak et al when pairs of liquid streams or jets are sufficiently close to one another that they not only generate corolla-like masses of air borne liquid spray in the ambient atmosphere above their points of impact with a metal surface, but in addition, the masses of spray combine to form "interaction fountains" of spray therebetween, which tend to shoot up even higher above the surface than the corolla-like masses alone, although Slayzak et al employed so-called guards between the pairs of jets to control the effect they wished to observe.
Figure 14:
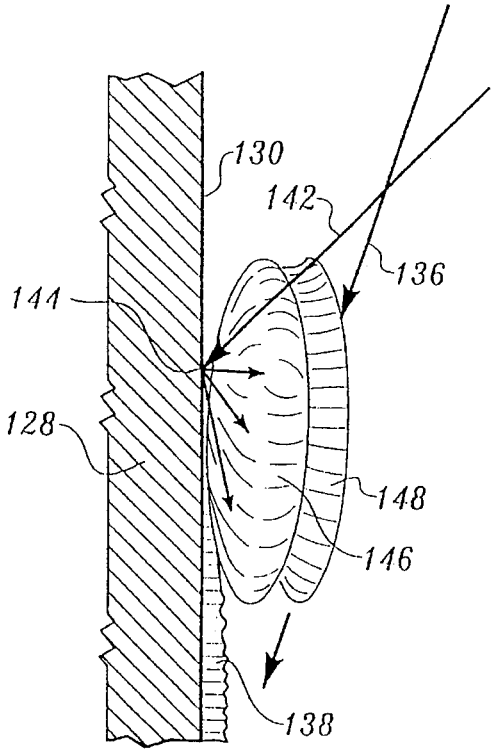
FIG. 14 is a further schematic illustration of the effect as it is employed in the present invention, and when seen at right angles to the respective pairs of liquid coolant streams as they impact the sides of the ingot, and the successive additional longitudinal portions of the layer of coolant thereon, respectively.
Figure 15:
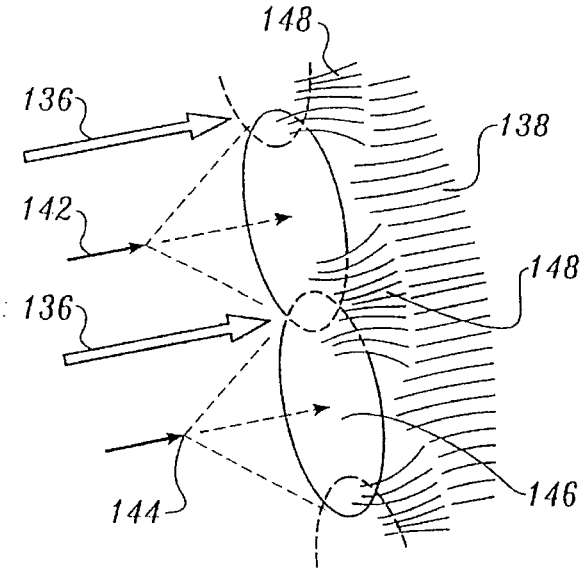
FIG. 15 is a still further schematic illustration of the effect, but showing the effect in perspective as the pairs of streams impact the surface of the ingot and the additional longitudinal portions of the layer of coolant thereon.

Given a sufficiently close spacing between the pairs of streams in the respective sets of streams 136 and 142, circumferentially of the mold, the corolla-like masses of liquid coolant spray 146 arising from the points of impact of pairs of the relatively adjacent 45 degree streams 142 of coolant, can be expected to form so-called "interaction fountains" 148 of spray that shoot up directly in the paths of the 22.5 degree streams 136 of coolant. This phenomenon is illustrated in FIG. 13, taken from the Slayzak et al article mentioned previously, but with slight changes in the legends thereon. As shown in the figure, and so as to isolate the phenomenon for the purposes of their observations, Slayzak et al mounted pairs of guards 150 between their respective pairs of "free jets" or streams 152. They then observed that when the jets or streams are sufficiently close to one another, the corolla-like masses of spray 146 arising from the points 144 of impact of the streams, actually merge with one another in the intervals of space between the streams, and in doing so, gush or shoot up into the ambient atmosphere above the surface 130 impacted, to the extent that "fountains" 148 of spray are formed in the intervals, well above the corollas 146 themselves. We in turn have observed that when captured and driven into the liquid coolant layers 138 by the 22.5 degree streams 136 of liquid coolant, in accordance with our process and apparatus, the fountains 148 of spray infuse the 22.5 degree streams 136 of coolant with considerable volumes of air-entrained coolant, or coolant entrained air, and the streams in turn infuse the layers with the same air-entrained coolant, or coolant entrained air, which in turn works a dramatic increase in the per unit volume heat extraction rate of the respective layers.

We have also observed that by employing separately controlled valved passages (not shown) at the centers of the end sections 42 of the lower chamber in the mold, similar to those shown in FIG. 8, and in lieu of the passages shown at 82, it is possible to selectively apply coolant to the ends of the ingot, as well as to the sides thereof. In such a case, however, the passages 82 should be walled off from the end sections 42 of the lower chamber, to supply only the upper chamber 38.

We claim:

1. In a process for casting molten metal into an elongated body of metal by the step of forcing molten metal through an open ended mold of a casting apparatus in the direction of the discharge end opening thereof from the entry end opening thereof and along an axis of the mold extending between the respective entry and discharge end openings thereof while in two successive stages of a casting operation attendant to the forcing step, a block which was initially cooperatively engaged with the discharge end opening of the mold, is retracted relatively along the axis of the mold through a succession of planes which extend transverse the axis of the mold at successively greater increments of distance from the discharge end opening of the mold in the direction relatively axially away from the entry end opening thereof, first to form an initial longitudinal section comprising the butt of the body of metal as the block is retracted through a series of first planes that extend transverse the axis of the mold relatively proximate to the discharge end opening thereof, and then in a successive steady state casting stage thereafter, to elongate the body of metal with additional longitudinal sections as the block is retracted through a series of second planes that extend transverse the axis of the mold relatively remote from the discharge end opening thereof, the outer peripheral surface of the body of metal being exposed meanwhile to the ambient atmosphere of the mold as the respective longitudinal sections in the body of metal are withdrawn from the mold through the series of first planes relatively proximate to the discharge end opening of the mold, the further steps of:

forming an initial longitudinal portion of a layer of liquid coolant on the outer peripheral surface of the initial longitudinal section in the body of metal as the block and the initial longitudinal section in the body of metal are withdrawn from the mold and passed through the series of first planes relatively proximate to the discharge end opening thereof, and while the block and first, the initial longitudinal section in the body of metal, and then the successive additional longitudinal sections in the body of metal, are passed through the series of second planes relatively remote from the discharge end opening of the mold during the steady state casting stage of the casting operation, discharging liquid coolant into the ambient atmosphere of the mold adjacent the discharge end opening thereof, forming an additional longitudinal portion of the layer of liquid coolant on each successive additional longitudinal section in the body of metal as the respective additional longitudinal sections are withdrawn from the mold through the series of first planes relatively proximate to the discharge end opening of the mold, discharging an additional fluid into the layer of ambient atmosphere of the mold immediately surrounding the outer peripheral surfaces of the respective additional longitudinal portions of the layer of liquid coolant, directing a portion of the additional fluid at the surfaces of the respective additional longitudinal portions of the layer of liquid coolant, so as to impact the additional fluid portion on the surfaces, and interposing a mass of air borne liquid coolant spray in the path of the additional fluid portion as the additional fluid portion is being directed at the surfaces of the respective additional longitudinal portions of the layer of liquid coolant, so that on impact with the surfaces, the additional fluid portion infuses the respective additional longitudinal portions of the layer of liquid coolant with additional air entrained liquid coolant that is adapted to modify the per unit volume heat extraction rate of the respective additional longitudinal portions of the liquid coolant layer.

2. The process according to claim 1 further comprising forming the liquid coolant discharge into pressurized streams of liquid coolant, directing the steams of liquid coolant at the outer peripheral surfaces of the additional longitudinal sections in the body of metal so as to form the respective additional longitudinal portions of the layer of liquid coolant thereon, forming the additional fluid discharge into pressurized jets of fluid, directing the jets of fluid at the outer peripheral surfaces of the respective additional longitudinal portions of the layer of liquid coolant, to impact therewith, and interposing a mass of airborne liquid coolant spray in the paths of the jets of additional fluid so that on impact therewith, the jets infuse the respective additional longitudinal portions of the layer of liquid coolant with additional air entrained liquid coolant.

3. The process according to claim 2 further comprising directing the respective streams of liquid coolant and jets of additional fluid at the surfaces of the respective additional longitudinal sections in the body of metal and the surfaces of the additional longitudinal portions of the layer of liquid coolant thereon, respectively, so as firstly, to crisscross portions of the respective streams and jets with one another in the layer of ambient atmosphere immediately surrounding the surfaces of the additional longitudinal portions of the layer of liquid coolant, and secondly, to interpose the portions of the liquid coolant streams in the paths of the portions of the jets of additional fluid, so that the portions of the liquid coolant streams are entrained in the portions of the jets and are impacted on the surfaces of the additional longitudinal portions of the layer of liquid coolant by the portions of the jets.

4. The process according to claim 2 wherein a mass of airborne liquid coolant spray is interposed in the paths of the respective jets of additional fluid by, firstly, directing the streams of liquid coolant along such relatively high angles of incidence to the axis of the mold that substantial portions of the respective liquid coolant streams rebound along angular paths from the surfaces of the additional longitudinal sections at the respective points of impact of the streams therewith, and form into corolla-shaped masses of liquid coolant spray in the layer of ambient atmosphere immediately surrounding the respective additional longitudinal portions of the layer of liquid coolant, and secondly, directing the jets of additional fluid along such relatively low angles of incidence to the axis of the mold, from locations between the discharge end opening of the mold and the points of impact of the liquid coolant streams with the surfaces of the additional longitudinal sections, that portions of the jets crisscross the angular paths of the corolla-shaped masses of airborne liquid coolant spray and entrain the spray therein.

5. The process according to claim 4 further comprising discharging the respective streams and jets from an annulus circumposed about the discharge end opening of the mold, and so angularly offsetting the streams and jets from one another axially of the mold, and so staggering the streams and jets from one another circumferentially of the mold, that the corolla-shaped masses of liquid coolant spray arising from the points of impact of relatively adjacent streams of coolant, combine to form interaction fountains of spray which shoot up directly in the paths of the jets of additional fluid.

6. The process according to claim 4 wherein the streams of liquid coolant are directed at the surfaces of the additional longitudinal sections in the body of metal along angles of incidence in the range of 30–105 degrees to the axis of the mold, and the jets of additional fluid are directed at the surfaces of the additional longitudinal portions of the layer of liquid coolant along angles of incidence in the range of 15–30 degrees to the axis of the mold.

7. The process according to claim 1 further comprising varying the initial longitudinal portion of the layer of liquid coolant formed on the initial longitudinal section in the body of metal in the butt forming stage of the casting operation, in a manner designed to reduce the per unit volume heat extraction rate thereof.

8. The process according to claim 1 wherein the additional fluid is also discharged into the layer of ambient atmosphere of the mold immediately surrounding the outer peripheral surface of the initial longitudinal portion of the layer of liquid coolant, a portion of the additional fluid is directed at the surface of the initial longitudinal portion, and a mass of airborne liquid coolant spray is interposed in the path of the additional fluid portion to infuse the initial longitudinal portion with additional air entrained liquid coolant that is adapted to modify the per unit volume heat extraction rate of the initial longitudinal portion.

9. The process according to claim 8 wherein the mold is adapted to form a body of metal having a polygonal cross section transverse the axis thereof, and the additional fluid portion is directed at the outer peripheral surface of the initial longitudinal portion of the layer of liquid coolant on opposing sides of the mold.

10. The process according to claim 1 wherein the axis of the mold extends along a vertical line and the molten metal is poured directly into the mold through the entry end opening thereof.

11. The process according to claim 1 wherein the additional fluid is discharged about the entire circumference of the outer peripheral surfaces of the respective additional longitudinal portions of the layer of liquid coolant.

12. The process according to claim 1 wherein the block is continuously retracted along the axis of the mold during the casting operation.

13. The process according to claim 1 wherein the mold has a continuous uninterrupted circumference about the axis thereof.

14. The process according to claim 1 wherein all of the additional fluid is discharged into the layer of ambient atmosphere of the mold immediately surrounding the outer peripheral surfaces of the respective additional longitudinal portions of the layer of liquid coolant through a series of spaced holes circumposed about the discharge end opening of the mold in an annulus thereof.

15. The process according to claim 1 wherein the additional fluid is a gas.

16. The process according to claim 1 wherein the additional fluid is additional liquid coolant.

17. The process according to claim 16 further comprising discharging the additional liquid coolant onto the initial longitudinal section in the body of metal during the butt forming stage of the casting operation, to form the initial longitudinal portion of the layer of liquid coolant thereon.

18. The process according to claim 16 wherein the first mentioned liquid coolant and the additional liquid coolant are discharged from the mold through a first and second series of spaced holes therein which are circumposed about the discharge end opening of the mold in an annulus thereof, and the process further comprises connecting the first and second series of holes with a pair of pressurized liquid coolant supply chambers in the body of the mold, so that sets of primary and secondary liquid coolant streams can be discharged from the first and second series of holes, respectively, and either directed at the respective additional longitudinal sections in the body of metal, and the respective additional longitudinal portions of the layer of liquid coolant on the surfaces thereof, respectively, so as to cool the body of metal during the steady state casting stage of the casting operation, or alternatively, selectively turned on and off at the respective supply chambers therefor, by controlling the flow of liquid coolant to the respective chambers, so that if desired, during the butt forming stage of the casting operation, only the secondary liquid coolant is directed at the initial longitudinal section in the body of metal to form the initial longitudinal portion of the layer of liquid coolant thereon.

19. The process according to claim 18 further comprising so angularly offsetting the first and second series of holes from one another axially of the mold, and so steeply inclining the first series of holes relative to the second series of holes, axially of the mold, that the respective chambers for supplying liquid coolant to the first and second series of holes, can be relatively juxtaposed to one another in the body of the mold, at locations relatively adjacent to and remote from the discharge end opening of the mold, respectively.

20. The process according to claim 19 further comprising interconnecting the respective chambers by a valve so that liquid coolant can be supplied to the chamber relatively remote from the discharge end opening of the mold, for delivery to both the first and second series of holes, but only supplied to the chamber relatively adjacent to the discharge end opening of the mold, through the valve, when the steady state casting stage of the casting operation is commenced.

21. The process according to claim 20 further comprising subdividing the relatively adjacent chamber into end sections and side sections, and directly interconnecting the end sections with the relatively remote chamber through open passages therebetween, while interconnecting the side sections with the relatively remote chamber through valves, so that liquid coolant can be supplied to the end sections of the relatively adjacent chamber at the same time that it is supplied to the relatively remote chamber, to direct cool opposing sides of the metal body during both the butt forming stage and the steady state casting stage of the casting operation.

22. The process according to claim 1 wherein the liquid coolant discharge is formed into pressurized streams of liquid coolant which are directed in steadily uninterrupted fashion at the respective longitudinal sections in the body of metal during the casting operation.

23. The process according to claim 1 further comprising forming the liquid coolant discharge into pressurized streams of liquid coolant, directing the streams of liquid coolant at the respective longitudinal sections in the body of metal during the butt forming and steady state casting stages of the casting operation, so that the streams tend to impact the outer peripheral surfaces of the respective longitudinal sections in a plane transverse the axis of the mold between the series of first planes and the discharge end opening of the mold, and form an initial longitudinal portion of the layer of liquid coolant on the outer peripheral surface of the initial longitudinal section which has a circumferential band of turbulence thereabout in the series of first planes, but then during the steady state casting stage of the casting operation, interposing a mass of airborne liquid coolant spray in the path of the additional fluid portion so as to form a circumferential band of turbulence about the respective additional longitudinal portions of the layer of liquid coolant, which is wider than the circumferential band of turbulence formed about the initial longitudinal portion of the layer of liquid coolant, axially of the mold.

24. The process according to claim 23 further comprising interposing the mass of airborne liquid coolant spray in the path of the additional fluid portion during the steady state casting stage to shift the plane at which the streams of liquid coolant tend to impact the surfaces of the respective longitudinal sections in the body of metal, in the axial direction relatively away from the plane at which the streams of coolant tended to impact the surfaces of the initial longitudinal section in the body of metal and toward the discharge end opening of the mold.

25. The process according to claim 23 further comprising forming a circumferential band of turbulence about the respective additional longitudinal portions of the layer of liquid coolant, which is coextensive with the last of the additional longitudinal sections by which the body of metal is elongated during the steady state casting stage of the casting operation.

26. In an apparatus for casting molten metal into an elongated body of metal, an open ended mold having an entry end opening, a discharge end opening, and an axis extending between the respective entry and discharge end openings thereof, and with which a block is initially cooperatively engaged at the discharge end opening of the mold to be retracted relatively along the axis of the mold through a succession of planes which extend transverse the axis of the mold at successively greater increments of distance from the discharge end opening of the mold in the direction relatively axially away from the entry end opening thereof, while in two successive stages of a casting operation attendant to the retraction of the block, molten metal is forced through the mold, first to form an initial longitudinal section comprising the butt of the body of metal as the block is retracted through a series of first planes that extend transverse the axis of the mold relatively proximate to the discharge end opening thereof, and then in a successive steady state casting stage thereafter, to elongate the body of metal with additional longitudinal sections as the block is retracted through a series of second planes that extend transverse the axis of the mold relatively remote from the discharge end opening thereof, the outer peripheral surface of the body of metal being exposed meanwhile to the ambient atmosphere of the mold as the respective longitudinal sections in the body of metal are withdrawn from the mold through the series of first planes relatively proximate to the discharge end opening of the mold, means for discharging liquid coolant into the ambient atmosphere of the mold adjacent the discharge end opening thereof, means for forming an initial longitudinal portion of a layer of liquid coolant on the outer peripheral surface of the initial longitudinal section in the body of metal as the block and the initial longitudinal section in the body of metal are withdrawn from the mold and passed through the series of first planes relatively proximate to the discharge end opening thereof, and then while the block and first, the initial longitudinal section in the body of metal, and then the successive additional longitudinal sections in the body of metal, are passed through the series of second planes relatively remote from the discharge end opening of the mold during the steady state casting stage of the casting operation, forming an additional longitudinal portion of the layer of liquid coolant on each successive additional longitudinal section in the body of metal as the respective additional longitudinal sections are withdrawn from the mold through the series of first planes relatively proximate to the discharge end opening of the mold, means for discharging an additional fluid into the layer of ambient atmosphere of the mold immediately surrounding the outer peripheral surfaces of the respective additional longitudinal portions of the layer of liquid coolant, means for directing a portion of the additional fluid at the surfaces of the respective additional longitudinal portions of the layer of liquid coolant, so as to impact the additional fluid portion on the surfaces, and means for interposing a mass of air borne liquid coolant spray in the path of the additional fluid portion as the additional fluid portion is being directed at the surfaces of the respective additional longitudinal portions of the layer of liquid coolant, so that on impact with the surfaces, the additional fluid portion infuses the respective additional longitudinal portions of the layer of liquid coolant with additional air entrained liquid coolant that is adapted to modify the per unit volume heat extraction rate of the respective additional longitudinal portions of the liquid coolant layer.

27. The apparatus according to claim 26 further comprising means for forming the liquid coolant discharge into pressurized streams of liquid coolant which are directed at the outer peripheral surfaces of the additional longitudinal sections in the body of metal so as to form the respective additional longitudinal portions of the layer of liquid coolant thereon, means for forming the additional fluid discharge into pressurized jets of fluid which are directed at the outer peripheral surfaces of the respective additional longitudinal portions of the layer of liquid coolant so as to impact therewith, and means for interposing a mass of airborne liquid coolant spray in the paths of the jets of additional fluid so that on impact therewith, the jets infuse the respective additional longitudinal portions of the layer of liquid coolant with additional air entrained liquid coolant.

28. The apparatus according to claim 27 further comprising means for directing the respective streams of liquid coolant and jets of additional fluid at the surfaces of the respective additional longitudinal sections in the body of metal and the surfaces of the additional longitudinal portions of the layer of liquid coolant thereon, respectively, so as to crisscross portions of the respective streams and jets with one another in the layer of ambient atmosphere immediately surrounding the surfaces of the additional longitudinal portions of the layer of liquid coolant, and to interpose the portions of the liquid coolant streams in the paths of the portions of the jets of additional fluid, so that the portions of the liquid coolant streams are entrained in the portions of the jets and are impacted on the surfaces of the additional longitudinal portions of the layer of liquid coolant by the portions of the jets.

29. The apparatus according to claim 27 wherein the means for interposing a mass of airborne liquid coolant spray in the paths of the respective jets of additional fluid include first fluid discharge control means operable to direct the streams of liquid coolant along such relatively high angles of incidence to the axis of the mold that substantial portions of the respective liquid coolant streams rebound along angular paths from the surfaces of the additional longitudinal sections at the respective points of impact of the streams therewith, and form into corolla-shaped masses of liquid coolant spray in the layer of ambient atmosphere immediately surrounding the respective additional longitudinal portions of the layer of liquid coolant, and second fluid discharge control means operable to direct the jets of additional fluid along such relatively low angles of incidence to the axis of the mold, from locations between the discharge end opening of the mold and the points of impact of the liquid coolant streams with the surfaces of the additional longitudinal sections, that portions of the jets criss-cross the angular paths of the corola-shaped masses of airborne liquid coolant spray and entrain the spray therein.

30. The apparatus according to claim 29 wherein the respective first and second fluid discharge control means are operable to discharge the respective streams and jets from an annulus circumposed about the discharge end opening of the mold, and to so angularly offset the streams and jets from one another axially of the mold, and so stagger the streams and jets from one another circumferentially of the mold, that the corola-shaped masses of liquid coolant spray arising from the points of impact of relatively adjacent streams of coolant, combine to form interaction fountains of spray which shoot up directly in the paths of the jets of additional fluid.

31. The apparatus according to claim 29 wherein the respective first and second fluid discharge control means are operable to direct the streams of liquid coolant at the surfaces of the additional longitudinal sections in the body of metal along angles of incidence in the range of 30–105 degrees to the axis of the mold, and to direct the jets of additional fluid at the surfaces of the additional longitudinal portions of the layer of liquid coolant along angles of incidence in the range of 15–30 degrees to the axis of the mold.

32. The apparatus according to claim 26 further comprising means for discharging additional fluid into the layer of ambient atmosphere of the mold immediately surrounding the outer peripheral surface of the initial longitudinal portion of the layer of liquid coolant, fluid discharge control means for directing a portion of the additional fluid at the surface of the initial longitudinal portion, to impact therewith, and means for interposing a mass of airborne liquid coolant spray in the path of the additional fluid portion as the additional fluid portion is being directed at the surface of the initial longitudinal portion, so that on impact therewith, the additional fluid portion infuses the initial longitudinal portion with additional air entrained liquid coolant that is adapted to modify the per unit volume heat extraction rate of the initial longitudinal portion.

33. The apparatus according to claim 32 wherein the mold is adapted to form a body of metal having a polygonal cross section transverse the axis thereof, and the fluid discharge control means are operable to direct the additional fluid portion at the outer peripheral surface of the initial longitudinal portion on opposing sides of the mold.

34. The apparatus according to claim 26 wherein the axis of the mold extends along a vertical line so that the molten metal can be poured directly into the mold through the entry end opening thereof.

35. The apparatus according to claim 26 wherein the additional fluid discharge means are operable to discharge the additional fluid about the entire circumference of the outer peripheral surfaces of the respective additional longitudinal portions of the layer of liquid coolant.

36. The apparatus according to claim 26 wherein the mold has a continuous uninterrupted circumference about the axis thereof.

37. The apparatus according to claim 26 wherein the additional fluid discharge means include a series of spaced holes circumposed about the discharge end opening of the mold in an annulus thereof.

38. The apparatus according to claim 26 wherein the additional fluid is additional liquid coolant.

39. The apparatus according to claim 38 further comprising means for discharging the additional liquid coolant onto the initial longitudinal section in the body of metal during the butt forming stage of the casting operation, to form the initial longitudinal portion of the layer of liquid coolant thereon.

40. The apparatus according to claim 39 wherein the mold has a first and second series of spaced holes therein which are circumposed about the discharge end opening of the mold in an annulus thereof, and a pair of pressurized liquid coolant supply chambers therein which are connected with the first and second series of holes, respectively, so that sets of primary and secondary liquid coolant streams can be discharged from the first and second series of holes, respectively, and the apparatus further comprises means for controlling the flow of liquid coolant to the respective chambers, whereby the sets of primary and secondary liquid coolant streams can be directed at the respective additional longitudinal sections in the body of metal, and the respective additional longitudinal portions of the layer of liquid coolant on the surfaces thereof, respectively, so as to cool the body of metal during the steady state casting stage of the casting operation, or alternatively, selectively turned on and off at the respective supply chambers therefor so that if desired, during the butt forming stage of the casting operation, only the secondary liquid coolant is directed at the initial longitudinal section in the body of metal to form the initial longitudinal portion of the layer of liquid coolant thereon.

41. The apparatus according to claim 40 wherein the respective chambers for supplying liquid coolant to the first and second series of holes, are relatively juxtaposed to one another in the body of the mold, at axially offset locations relatively adjacent to and remote from the discharge end opening of the mold, respectively.

42. The apparatus according to claim 41 wherein the liquid coolant flow control means include a valve interconnecting the respective chambers so that liquid coolant can be supplied to the chamber relatively remote from the discharge end opening of the mold, for delivery to both the first and second series of holes, but only supplied to the chamber relatively adjacent to the discharge end opening of the mold, through the valve, when the steady state casting stage of the operation is commenced.

43. The apparatus according to claim 42 wherein the mold is adapted to form a body of metal having a generally rectangular cross section transverse the axis thereof, the relatively adjacent chamber is subdivided into end sections and side sections, the end sections are directly interconnected with the relatively remote chamber through open passages therebetween, and the side sections are interconnected with the relatively remote chamber through valves, so that liquid coolant can be supplied to the end sections of the relatively adjacent chamber at the same time as it is supplied to the relatively remote chamber, to direct cool the ends of the body of metal during both the butt forming stage and the steady state casting stage of the casting operation.

* * * * *